US006847337B2

(12) United States Patent
Ichikawa

(10) Patent No.: US 6,847,337 B2
(45) Date of Patent: Jan. 25, 2005

(54) DRIVING APPARATUS AND DRIVING METHOD FOR AN ELECTRON SOURCE AND DRIVING METHOD FOR AN IMAGE-FORMING APPARATUS

(75) Inventor: Takeshi Ichikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 10/173,632

(22) Filed: Jun. 19, 2002

(65) Prior Publication Data

US 2003/0006946 A1 Jan. 9, 2003

(30) Foreign Application Priority Data

Jun. 29, 2001 (JP) ..... 2001-200147
Jun. 4, 2002 (JP) ..... 2002-163459

(51) Int. Cl.[7] ..... G09G 1/06

(52) U.S. Cl. ..... 345/11; 345/28; 345/29; 345/75.2; 315/368.17

(58) Field of Search ..... 345/10–14, 20–22, 345/27–29, 72–73, 74.1, 75.1, 75.2, 90–96; 315/1, 368.17, 368.18

(56) References Cited

U.S. PATENT DOCUMENTS 5,103,144 A * 4/1992 Dunham ..... 315/366
5,939,823 A 8/1999 Kiyomiya et al. ..... 313/495
6,346,773 B1 * 2/2002 Takegami ..... 315/169.1
6,448,948 B1 * 9/2002 Friedman ..... 345/74.1
6,621,475 B1 * 9/2003 Yamaguchi et al. ..... 345/74.1
6,638,128 B1 * 10/2003 Suzuki ..... 445/6

FOREIGN PATENT DOCUMENTS

JP 08-096703 4/1996 ..... H01J/1/30
JP 08-096704 4/1996 ..... H01J/1/30

OTHER PUBLICATIONS

Suzuki, M., et al., *An Mim–cathode Array for Cathodoluminescent Displays* FED 5–3, IDW '96, pp. 529–530.
Dittmer; "Electrical Conduction and Electron Emission of Discontinuous Thin Films," 9 Thin Solid Films; 317–328 (1972).
Dyke et al.; "Field Emission," 8 Advances in Electronics and Electron Physics; 89–185 (1956).
Elinson et al.; "The Emission of Hot Electrons and the Field Emission of Electrons from Tin Oxide," Radio Engineering and Electronic Physics; 1290–1296 (1965).
Kusunoki et al.; "Fluctuation–Free Electron Emission from Non–Formed Metal–Insulator–Metal (MIM) Cathodes Fabricated by Low Current Anodic Oxidation," 32 (11B) Jpn. J. Appl. Phys.; 1695–1697 (1993).

(List continued on next page.)

*Primary Examiner*—Regina Liang
*Assistant Examiner*—Duc G. Dinh
(74) *Attorney, Agent, or Firm*—Fitzpatrick, Cella, Harper & Scinto

(57) ABSTRACT

With the present invention, there is provided a driving method that favorably drives an electron source, which is driven in a passive matrix manner, without being affected by a disturbance. There is also provided an image-forming apparatus that uses this electron source. An anode electrode having a constant potential is arranged over a plurality of electron-emitting devices including gate electrodes and cathode electrodes. During passive matrix driving of the electron source where the amount of electrons to be emitted is adjusted by modulating potentials between the cathode electrodes and the gate electrodes, a predetermined time difference is maintained between the driving of signal lines in a group and the driving of signal lines in another group during the driving of signal lines divided into N groups after selection of scanning lines. If a scanning line capacity is referred to as C and a scanning line resistance is referred to as R, this time difference is set so as to be equal to or more than CR (approximately equal to CR).

14 Claims, 16 Drawing Sheets

OTHER PUBLICATIONS

Mead; "Operation of Tunnel–Emission Devices," 32 (4) J. Appl. Phys.; 646–652 (1961).

Spindt et al.; "Physical Properties of Thin–Film Emission Cathodes with Molybdenum Cones," 47 (12) J. Appl. Phys.; 5248–5263 (1976).

M. Hartwell et al., Strong Electron Emission From Patterned Tin–Indium Oxide Thin Films, IEDM 1975, pp. 519–521.

* cited by examiner

DRIVING APPARATUS AND DRIVING METHOD FOR AN ELECTRON SOURCE AND DRIVING METHOD FOR AN IMAGE-FORMING APPARATUS

BACKGROUND OF THE INVENTION

1. Field of the Invention

The present invention relates to a driving apparatus and driving method for an electron source having a plurality of electron-emitting devices. The present invention further relates to a driving method for an image-forming apparatus using the electron source.

2. Description of the Related Art

Electron-emitting devices heretofore known are generally grouped into two types: a thermionic cathode and a cold cathode. The cold cathode includes field-emission (FE) devices, metal-insulator-metal (MIM) devices, and surface conduction electron-emitting devices.

For example, an FE-type device, such as the one disclosed by W. P. Dyke and W. W. Dolan in "Field Emission", Advance in Electron Physics, 8,89 (1956), or the one disclosed by C. A. Spindt in "PHYSICAL Properties of thin-film field emission cathodes with molybdenum cones", J. Apply. phys., 47, 5248 (1976), is known.

An MIM-type device, such as the one disclosed by C. A. Mead in "Operation of Tunnel-Emission Devices", J. Appl. Phys. 32,646 (1961), is known.

Also, examples of devices which have been recently studied are as follows: Toshiaki. Kusunoki, "Fluctuation-free electron emission from non-formed metal-insulator-metal (MIM) cathodes Fabricated by low current Anodic oxidation", Jpn. J. Appl. Phys. vol. 32 (1993) pp. L1695, and Mutsumi Suzuki et al., "An MIM-Cathode Array for Cathode luminescent Displays", IDW'96, (1996) pp. 529.

As an example of the surface conduction electron-emitting device, there is known the one described in Elinson's report (M. I. Elinson, Radio. Eng. Electron Phys., 10 (1995)) or the like. The surface conduction electron-emitting device is a device utilizing the phenomenon in which a current is caused to flow in a small-area thin film formed on a substrate so as to be parallel to the film surface, so that a electron emission is realized. As the surface conduction electron-emitting device, there are reported a device using an $SiO_2$ thin film described in the Elinson 's report, a device using an Au thin film (G. Dittmer. Thin Solid Films, 9,317 (1972)), a device using an $In_2O_3/SnO_2$ thin film (M. Hartwell and C. G. Fonstad, IEEE Trans. ED Conf., 519 (1983)) and the like.

Various techniques may be adopted to arrange the electron-emitting devices. As one example, a plurality of electron-emitting devices are arranged in an X direction and a Y direction to form rows and columns. There may be used a passive matrix arrangement where once end of the electrode of each of the plural electron-emitting devices arranged on the same row is commonly connected to X-directional wiring, while the other end of the electrode of each of the plural electron-emitting devices arranged on the same column is commonly connected to Y-directional wiring. This passive matrix configuration will be described in detail below with reference to FIG. 12.

X-directional wiring 62 includes n lines (Dx1, Dx2, . . . , Dxm) and is constructed from a conductive metal or the like that has been formed using a vacuum deposition method, a printing method, a sputtering method, or the like.

The material, thickness, and width of the wiring are determined as appropriate. Y-directional wiring 63 includes n lines (Dy1, Dy2, . . . , Dyn) and is produced in the same manner as the X-directional wiring 62. An interlayer insulating layer (not shown) is provided between the X-directional wiring 62 including the m lines and the Y-directional wiring 63 including the n lines so as to electrically separate these wirings (m and n are each a positive integer).

The interlayer insulating layer (not shown) is formed using $SiO_2$ or the like with a vacuum deposition method, a printing method, a sputtering method, or the like. For instance, the interlayer insulating layer having a desired shape is formed to cover the entire or a part of the surface of a substrate 61 on which the X-directional wiring 62 has been formed. In particular, the thickness, material, and production method of the interlayer insulating layer are determined as appropriate so that the interlayer insulating layer is resistant to potential differences at intersections of the X-directional wiring 62 and the Y-directional wiring 63. The X-directional wiring 62 and the Y-directional wiring 63 are led out to the outside as external terminals.

There may be a case where the m lines of the X-directional wiring 62 constituting electron-emitting devices 64 double as cathode electrodes. Also, there may be a case where the n lines of the Y-directional wiring 63 double as gate electrodes. Further, there may be a case where the interlayer insulating layer doubles as an insulating layer between the gate electrodes and the cathode electrodes.

To select the rows of the electron-emitting devices 64 arranged in the X-direction, a scanning signal applying means for applying a scanning signal is connected to the X-directional wiring 62. On the other hand, to modulate each column of the electron-emitting devices 64 arranged in the Y-direction in accordance with an input signal, a modulation signal generating means is connected to the Y-directional wiring 63. The driving voltage applied to each electron-emitting device is supplied as a differential voltage between the scanning signal and modulation signal applied to the device.

The application of these electron-emitting devices to an image-forming apparatus necessitates emission currents with which phosphors emit light having sufficient brightness. On the other hand, it is also required that the electron-emitting devices are controlled so as to emit no electron under their OFF states. Also, needless to say, the increase of the number of steps of gradation is an important factor when image quality is enhanced. Further, to realize higher definition of a display, it is required that the diameter of an electron beam irradiated onto each phosphor is reduced and the number of pixels is also increased. It is also important that the electron-emitting devices are easy to manufacture.

An example of the conventional FE type electron-emitting device is a Spindt type electron-emitting device. The Spindt type electron-emitting device generally has a construction where a micro-tip is formed as an emission point and electrons are emitted from the tip thereof. With this construction, if an emission current density is increased to have a phosphor emit light, this causes the thermal destruction of an electron-emitting region, which limits the life span of the FE device. Also, the diameter of an electron beam emitted from the tip tends to be increased by an electric field formed by a gate electrode, which results in a shortcoming that it becomes impossible to decrease the beam diameter.

Various techniques have been proposed individually to overcome these shortcomings of the FE device.

There is proposed a technique such that, to prevent the increase of the electron beam diameter, a converging electrode is arranged over an electron-emitting region. In general, with this construction, the diameter of emitted electron beam is decreased by the negative potential of the converging electrode. However, the manufacturing process becomes complicated and therefore the manufacturing cost is increased.

With another technique, an electron beam diameter is decreased by eliminating a micro-tip like that used in the Spindt type electron-emitting device. Examples of this technique are described in JP 8-096703 A and JP 8-096704 A.

With this technique, electrons are emitted from a thin film arranged in a hole. In this case, a flat equipotential surface is formed on the surface of an electron-emitting film, so that there is obtained an advantage that the electron beam diameter is decreased. Also, by using a construction material having a low work function as an electron-emitting substance, electron emission becomes possible even without forming a micro-tip , which makes it possible to lower a driving voltage. There is also obtained an advantage that the manufacturing method is relatively simplified. Further, electron emission is performed in a plane area, so that electric fields do not excessively concentrate. As a result, the destruction of the tip does not occur and a long life span is realized.

In such an FE type electron-emitting device, an electric filed ($1\times10^8$ V/m to $1\times10^{10}$ V/m in usual cases of the Spindt type) that is necessary for electron emission is applied to an electron-emitting substance, which is usually connected to a cathode electrode, by a gate electrode arranged close to the electron-emitting substance. In this manner, it becomes possible to perform electron emission. Also, in usual cases, electrons emitted from an electron-emitting device are accelerated by an electric field formed between the device and an anode electrode arranged over the device. In this manner, there is given sufficient energy. The electrons that reach the anode electrode are captured by the anode electrode and are converted into an emission current.

In usual cases, modulation voltages applied between cathode electrodes and gate electrodes are set so as to fall within a range of from several tens of V to several hundreds of V, while voltages applied between the cathode electrodes and an anode electrode is set so as to fall within a range of from several hundreds of V to several tens of kV. That is, the voltages are increased by several ten to several hundred times as compared with the modulation voltages applied between the cathode electrodes and the gate electrodes.

Accordingly, ON-OFF control of electron emission from the devices is generally performed by modulating the voltages between the cathode electrodes and the gate electrodes to which small modulation voltages are applied. An example method of driving these electron-emitting devices is disclosed in JP 8-096703 A. This method is shown in FIG. 15 and will be briefly described below.

With the illustrated construction, anode voltages for RGB are modulated in a time-division manner to display a color image. Fundamentally, however, the voltage applied to an anode electrode is maintained constant (250 V) and a signal for image display is realized by modulating (20 V) the voltages applied between cathode electrodes and gate electrodes. Also, during an OFF period, both of the voltages of the cathode electrodes and the gate electrodes have the same potential and are set at 0V. Further, the distance between the cathode electrodes and the anode electrode is set at 300 $\mu$m. First, a potential of $-\beta$ V is given to a cathode that is a selected scanning line and a potential of a V is applied to a gate that is a signal line for a required time period in accordance with the application of the potential of $-\beta$ V. During this operation, a voltage of $\alpha+\beta$ V is applied between the gate and cathode, thereby emitting electrons. When one scanning period is finished, the potential of the cathode that is the selected scanning line becomes 0 V and the potential of a cathode that is the next selected scanning line becomes $-\beta$ V, thereby repeating the operation described above in succession. Also, in the case where the anode potential is maintained constant, it is preferable that the distance between the cathodes and the anode is reduced to decrease a beam diameter. However, the indiscriminate reduction of the distance should be avoided in order to obtain a vacuum space without difficulty and to circumvent discharging.

SUMMARY OF THE INVENTION

During the aforementioned passive matrix driving, there occurs a disturbance of a voltage due to the crosstalk between scanning lines and signal lines and capacity coupling. In particular, in the case of electron-emitting devices, it is preferable that the devices are formed at intersections of the scanning lines and the signal lines because there are maintained large areas in which electron emission is performed. On the other hand, this construction where the devices are arranged at the intersections is not preferable in view of the disturbance of a voltage because overlapping areas are increased and therefore the capacities of the scanning lines and the signal lines are increased.

By referring to FIG. 16, the disturbance of a voltage described above will be described by explaining state changes that occur during line-sequential driving of electron-emitting devices that are arranged in a passive matrix manner. FIG. 16 is a timing chart in the case where the plurality of electron-emitting devices 64 shown in FIG. 12 arranged in a passive matrix manner are operated. The following description will be made by taking a case of m=n=5 as an example. An anode voltage is set at Va and is maintained constant. FIG. 16 shows a potential waveform applied to each scanning line (Dx1 to Dx5) and a potential waveform applied to each signal line (Dy1 to Dy5). Note that in the example to be described below, the scanning lines 62 are connected to cathode electrodes of respective electron-emitting devices 64 and signal lines are connected to gate electrodes of respective electron-emitting devices 64.

First, all terminals are reset to an OFF state. In more detail, the potentials of the scanning lines are set so as to become higher than the potentials of the signal lines (for instance, all of the potentials of the scanning lines are set at 20 V and all of the potentials of the signal lines are set at 0 V). By doing so, a voltage of −20 V is applied to the electron-emitting devices and all electron-emitting devices are placed in an OFF state (state where no electron is emitted).

Next, the potential of the scanning line Dx1 is changed and is placed in an ON state ($V_{xOn}$=0 V, for instance). By doing so, a potential of 0 V is applied to the cathode of the electron-emitting device connected to Dx1.

Following this, an ON signal $V_{yOn}$ is simultaneously applied to all signal lines connected to electron-emitting devices that should be placed in an ON state (for instance, electron-emitting devices connected to Dy1 to Dy4). If the ON signal has a potential of 20 V, for instance, 20 V is applied to Dy1 to Dy4. During this operation, the electron-emitting device at each intersection of Dx1 and Dy1 to Dy4 emits light.

It should be noted here that Dy5 is always placed in an OFF state through one scanning period (a period from a timing at which a scanning line is selected to a timing at which the next scanning line is selected), so that 0 V that is the potential of $V_{yOff}$ is continuously given to Dy5.

Also, in the case of time-division pulse gradation (pulse width modulation), the $V_{yOff}$ voltage is supplied so as to have certain pixels emit light at the same time and place Dyi in the OFF state in succession in accordance with a gradation. In the example shown in FIG. 16, three signal lines Dy1 to Dy3 are applied with $V_{yOff}$ (=0 V) that is the OFF potential after a time period that is half of one scanning period has passed, thereby displaying a halftone. To Dy4, there is applied 0 V that is the potential of $V_{yOff}$ after this line is selected during one scanning period.

Then, when a time period for applying a scanning signal to Dx1 during one scanning period has passed, the potential of Dx1 is changed to 20 V that is the OFF potential $V_{xOff}$. During this operation, all of the electron-emitting devices return to the OFF state (reset state) described above.

Following this, the scanning line Dx2 is placed in the ON state and the ON state potential is applied to Dyi for a time period corresponding to its gradation by performing a driving operation that is the same as the driving operation performed for Dx1. This operation is repeated in succession until the operation is performed for the last scanning line (Dx5) (line-sequential driving is performed), thereby finishing the display of one frame.

In this example, there has been described a case of 5×5 for ease of explanation. In the case where the resolution is XGA, for instance, the total number of intersections of a matrix becomes 1024 ×768. Further, when consideration is given to RGB, the total number of the scanning lines becomes m=768 and the total number of signal lines becomes n=1024×3=3072 .

Next, there will be described a problem that if Dx1 is selected ($V_{xOn}$ is applied), for instance, the changing of the potentials of the signal lines Dy1, Dy2, and Dy3 also affects other lines.

The scanning line Dx1 forms a capacity Cd with the signal lines Dy1 to Dy5. Also, if a parasitic capacitance that is the capacity of the scanning line Dx1 with lines other than the signal lines is referred to as Cpx, the capacity (Cox) of the Dx1 wiring becomes Cox=Cpx+5Cd that is the sum of Cpx and Cd×5. This value is basically the same for all scanning lines (Dxi). On the other hand, the capacity (Coy) of the signal line Dyi becomes Coy=Cpy+5Cd that is the sum of the parasitic capacitance Cpy and the capacities Cd×5 formed by the signal line Dyi and the scanning lines Dx1 to Dx5.

Here, for instance, there will be described voltage changes occurring at a timing "A" at which Dy1 to Dy3 are turned off at the same time after an ON signal is initially inputted into Dy1 to Dy4 (see FIG. 16). In this case, all of Dx1 to Dx5 exhibit voltage changes due to the capacity coupling expressed by δV=20 V×3Cd/ (Cpx+5Cd). For instance, if Cpx=Cd, voltage dropping of around 10 V occurs to δV. The voltage is supplied from a voltage source, so that this voltage does not steadily vary as potentials of the scanning lines. However, as shown in FIG. 16, this voltage varies for the time period of a time constant of CR.

Accordingly, in each electron-emitting device located at intersections of respective scanning lines Dx2 to Dx5 and Dy4, the potentials of Dx2 to Dx5 each become 10 V and the potential of Dy4 becomes 20 V, so that 10 V (disturbance potential) that is the difference therebetween is applied to each electron-emitting device as it is (the potential waveform located at the second level from the bottom in FIG. 16 is a voltage waveform applied to the intersection of Dy4 and Dx2). If this disturbance potential (10 V) does not exceed a threshold value of the electron-emitting device, no electron is emitted. However, if this disturbance potential is equal to or more than the threshold value, electron emission is performed.

In addition, there is a probability that this disturbance will occur by y times, which results in a large disturbance. Here, the description has been made by assuming that m=n=5, so that δV becomes 10 V and remains low. However, in the case of an ordinary image-forming apparatus in which m and n become extremely large, δV approaches almost 20 V. As a result, electron-emitting devices that are originally placed in a state where no electron will be emitted emit electrons, which results in a problem concerning display quality.

In the case of a device like a liquid crystal apparatus where light emission is continued through a frame period and there is obtained a light emission intensity by frame integration, the light emission during such a short time period hardly affects image quality. However, in an image-forming apparatus that utilizes electron emission, there is obtained brightness using momentary light emission (impulse-shaped output), so that disturbed emitted light directly and significantly affects image quality.

Another problem shown in the timing chart (FIG. 16) described above is caused by the electron-emitting device at the intersection between Dx1 and Dy5. A signal designating black display is inputted into this device, but there occurs light emission in this device when Dy1 to Dy3 are placed in an OFF state. However, this situation occurs only once for one frame, so that the importance of this problem is minor in comparison with the aforementioned problem caused by the unselected scanning lines.

When an image-forming apparatus is constructed under these conditions, pixels (electron-emitting devices) that should remain in the OFF state are placed in the ON state in the case of an ordinary driving method, which leads to a problem that there occurs the lowering of contrast.

The present invention has been made to solve the problems of the related art described above, and an object of the present invention is to propose an apparatus and a method with which an electron beam diameter is reduced and an electron source having a plurality of electron-emitting devices that are capable of realizing high efficiency is favorably driven when the electron source is driven by performing passive matrix driving. Further, another object of the present invention is to provide a high-definition image-forming apparatus that realizes high image quality using this electron source.

To achieve the object described above, an electron source driving apparatus, an electron source driving method, an image-forming apparatus using the same, and a method of driving the image-forming apparatus according to the present invention are constructed as follows.

The present invention relates to an electron source driving apparatus for an electron source where a plurality of electron-emitting devices are connected to a plurality of scanning lines and a plurality of signal lines crossing the plurality of scanning lines, comprising:

a scanning means for performing, for all of the plurality of scanning lines in succession, an operation including selection of a desired scanning line out of the plurality of scanning lines, application of a selection signal to the selected scanning line, and application of a non-selection signal to each unselected scanning line; and a signal line driving means for dividing the plurality of signal lines into a plurality of groups and applying a selection signal to the plurality of signal lines so that timings, at which the application of the selection signal to respective groups is started, are shifted from each other, wherein if an electric capacity of the scanning lines is referred to as C and electric resistance of the scanning lines is referred to as R, a time difference that is equal to or more than a value obtained by a multiplication of CR by 0.9 is maintained between the timings at which the application of the selection signal to respective groups is started.

Also, the present invention relates to an electron source driving apparatus for a matrix-shaped electron source where a plurality of electron-emitting devices are connected to a plurality of scanning lines and a plurality of signal lines crossing the plurality of scanning lines, comprising:

a scanning means for performing, for all of the plurality of scanning lines in succession, an operation including selection of a desired scanning line out of the plurality of scanning lines, application of a selection signal to the selected scanning line, and application of a non-selection signal to each unselected scanning line; and a signal line driving means for dividing the plurality of signal lines into a plurality of groups and applying a selection signal to the plurality of signal lines so that timings, at which the application of the selection signal to respective groups is started, are shifted from each other, wherein if an electric capacity of the scanning lines is referred to as C and electric resistance of the scanning lines is referred to as R, a time difference that is equal to or more than CR is maintained between the timings at which the application of the selection signal to respective groups is started.

In the electron source driving apparatus of the invention, it is preferred that the signal line driving means has a function of driving all of the signal lines while the desired scanning line is being selected.

In the electron source driving apparatus of the invention, it is preferred that the selection signal that the signal line driving means applies to the signal lines is a potential having a pulse waveform that is a signal having a pulse width modulated in accordance with a gradation of an inputted image signal.

In the electron source driving apparatus of the invention, it is preferred that the selection signal that the signal line driving means applies is a potential having a pulse waveform that is a signal having a peak value modulated in accordance with a gradation of an inputted image signal. In the electron source driving apparatus of the invention, it is preferred that the selection signal is applied by dividing the plurality of signal lines into groups the number of which is in a range of from 2 to 10.

Also, the present invention relates to an electron source driving method for an electron source where a plurality of electron-emitting devices are connected to a plurality of scanning lines and a plurality of signal lines crossing the plurality of scanning lines, the electron source driving method comprising:

performing, for all of the plurality of scanning lines in succession, an operation including selection of a desired scanning line out of the plurality of scanning lines, application of a selection signal to the selected scanning line, and application of a non-selection signal to each unselected scanning line; and dividing the plurality of signal lines into a plurality of groups and, if an electric capacity of the scanning lines is referred to as C and electric resistance of the scanning lines is referred to as R, maintaining a time difference that is equal to or more than a value obtained by a multiplication of CR by 0.9 between respective timings at which the application of the selection signal to respective groups is started.

Also, the present invention relates to an electron source driving method for an electron source where a plurality of electron-emitting devices are connected to a plurality of scanning lines and a plurality of signal lines crossing the plurality of scanning lines, comprising:

performing, for all of the plurality of scanning lines in succession, an operation including selection of a desired scanning line out of the plurality of scanning lines, application of a selection signal to the selected scanning line, and application of a non-selection signal to each unselected scanning line; and dividing the plurality of signal lines into a plurality of groups and, if an electric capacity of the scanning lines is referred to as C and electric resistance of the scanning lines is referred to as R, maintaining a time difference that is equal to or more than CR between respective timings at which the application of the selection signal to respective groups is started.

In the electron source driving method of the invention, it is preferred that all of the signal lines are driven during one scanning period.

In the electron source driving method of the invention, it is preferred that the signal applied to the signal lines is a potential having a pulse waveform that has a pulse width modulated in accordance with a gradation of an inputted image signal.

In the electron source driving method of the invention, it is preferred that the signal applied to the signal lines is a potential having a pulse waveform that has a peak value modulated in accordance with a gradation of an inputted image signal.

In the electron source driving method of the invention, it is preferred the selection signal is applied by dividing the plurality of signal lines into groups the number of which is in a range of from 2 to 10.

In the electron source driving method of the invention, it is preferred that the plurality of electron-emitting devices are provided at respective intersections of the scanning lines and the signal lines.

Also, the present invention relates to an image-forming apparatus driving method for an image-forming apparatus including:

an electron source; and an image-forming member that forms an image using electrons emitted from the electron source, wherein an image is formed by driving the electron source with the above-mentioned driving method.

With this construction, in the electron source and the image-forming apparatus that use a driving method for a field emission type electron-emitting device to which the present invention is applicable, an electron beam diameter is reduced. Also, when a high-efficiency electron-emitting device is driven by performing passive matrix driving, even if there occurs a disturbance of a voltage due to the driving, this situation does not affect image quality. As a result, it becomes possible to provide a high-quality image.

DETAILED DESCRIPTION OF THE PREFERRED EMBODIMENTS

The best mode for carrying out the present invention will be exemplarily described in detail below with reference to FIGS. 1 to 8. Note that, unless otherwise specified, there is no intention to limit the scope of the present invention to the sizes, materials, shapes, relative positions, and other aspects of components to be described below. Also, needless to say, unless otherwise specified, there is no intention to limit the scope of the present invention to conditions, such as the potentials applied to cathode electrodes, gate electrodes, and an anode electrode, a driving waveform, and the like.

Figure 1:
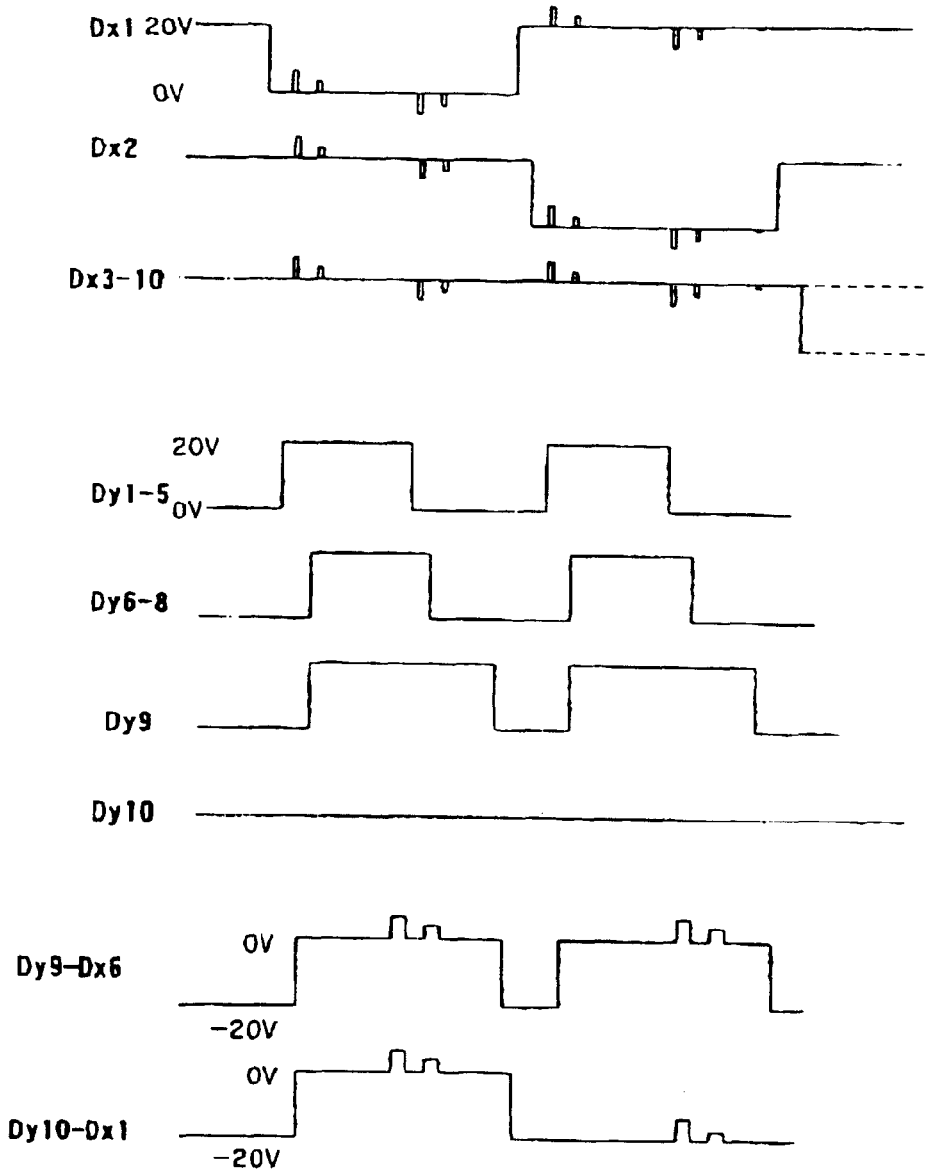
FIG. 1 is a timing chart illustrating an electron-emitting device driving method according to the present invention.
Figure 2A:
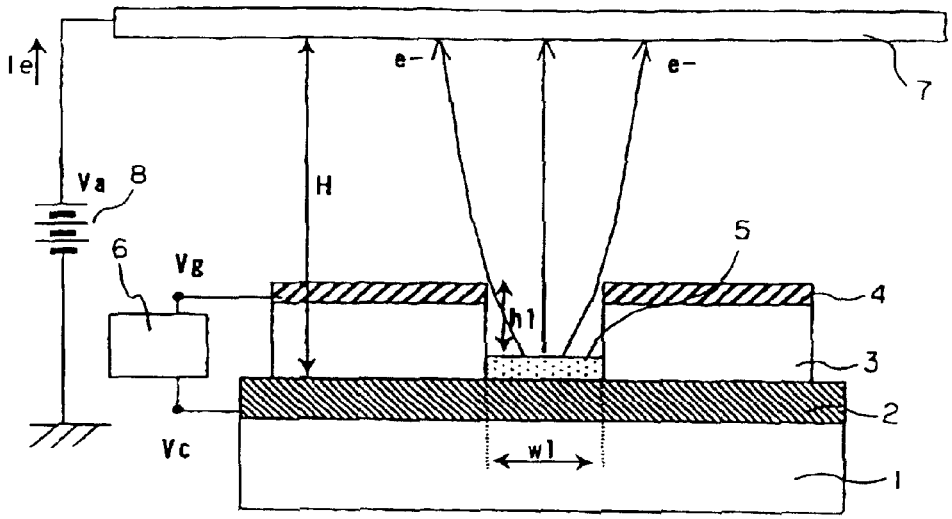
FIGS. 2A and 2B show a basic construction of an electron-emitting device that is applicable to the present invention.
Figure 2B:
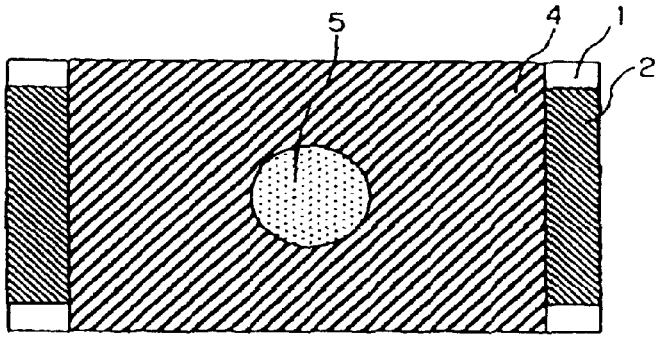
Figure 3:
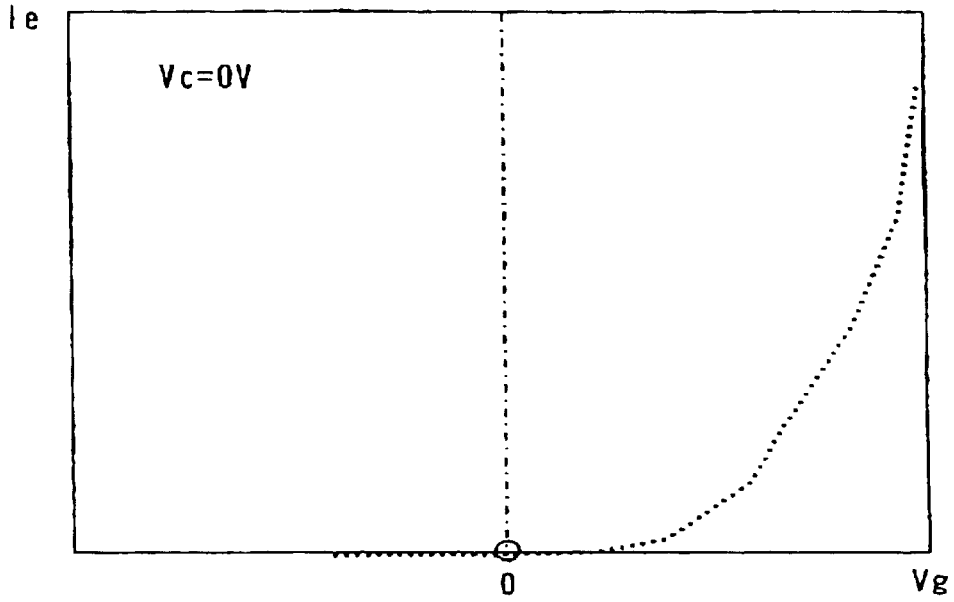
FIG. 3 shows a current-voltage characteristic of an electron-emitting device according to the present invention.

FIGS. 2A and 2B are schematic diagrams showing an electron-emitting device having the most basic construction to which the driving method of the present invention is preferably applied. FIG. 2A is a cross-sectional view, while FIG. 2B is a plan view. Also, FIG. 3 shows a driving voltage and an emission current in the case where this device is driven (ON-OFF state). Also, FIG. 1 illustrates conditions concerning the driving of the device of the present invention shown in FIGS. 2A, 2B, and 3.

In FIGS. 2A and 2B, reference numeral 1 represents a substrate, numeral 2 a cathode electrode, numeral 3 an insulating layer, numeral 4 a gate electrode, and numeral 5 an electron-emitting layer. These construction elements constitute the electron-emitting device.

A cathode voltage Vc and a gate voltage Vg are modulated and applied to the cathode electrode 2 and the gate electrode 4, respectively, by a power supply 6. In this manner, a voltage (Vg-Vc) is given as a driving voltage between the cathode electrode 2 and the gate electrode 4.

Reference numeral 7 denotes an anode electrode, and an anode voltage Va is given by a high voltage power supply 8. The anode electrode 7 captures electrons and detects an electron emission current Ie.

Also, in the electron-emitting device shown in FIGS. 2A and 2B, there is formed a hole whose width is w1 and height is h1. Also, the anode electrode 7 is arranged so as to be upwardly separated from the electron-emitting device with a distance of H therebetween. In usual cases, the position of the device where the distance H is maintained between the anode electrode 7 and the device is determined with reference to the position of the cathode electrode 2.

Under a driving state, a cathode potential, a gate potential, and an anode potential are applied and an electric field corresponding to these potentials is formed.

FIG. 3 shows a device voltage-emission current characteristic of the present invention. In the case where the voltage is 0V or negative, no current flows. A current starts to flow when the voltage exceeds a threshold value.

Figure 4A:
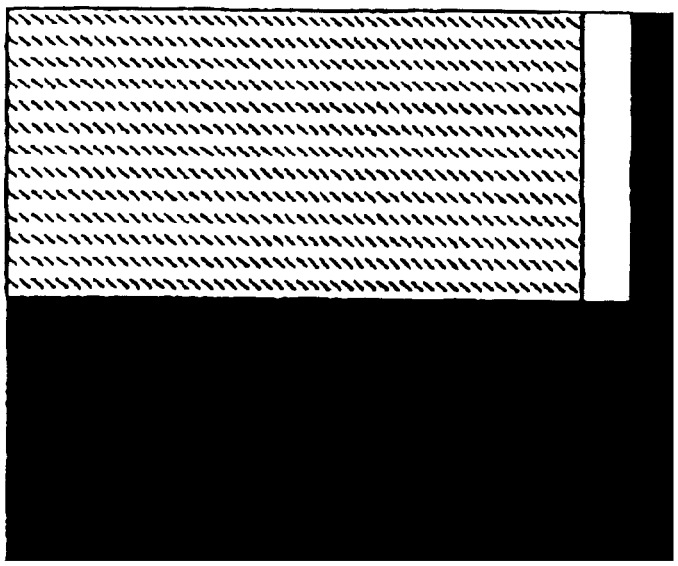
FIGS. 4A and 4B show display examples of the electron-emitting device according to the present invention.
Figure 4B:
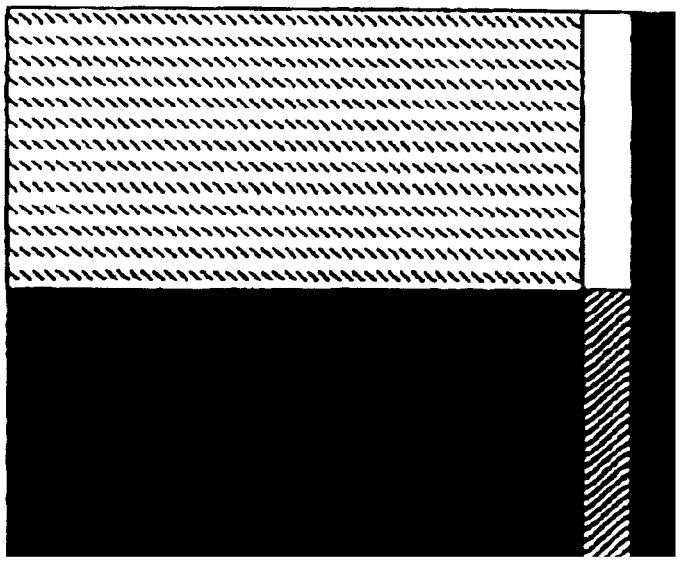
Figure 12:
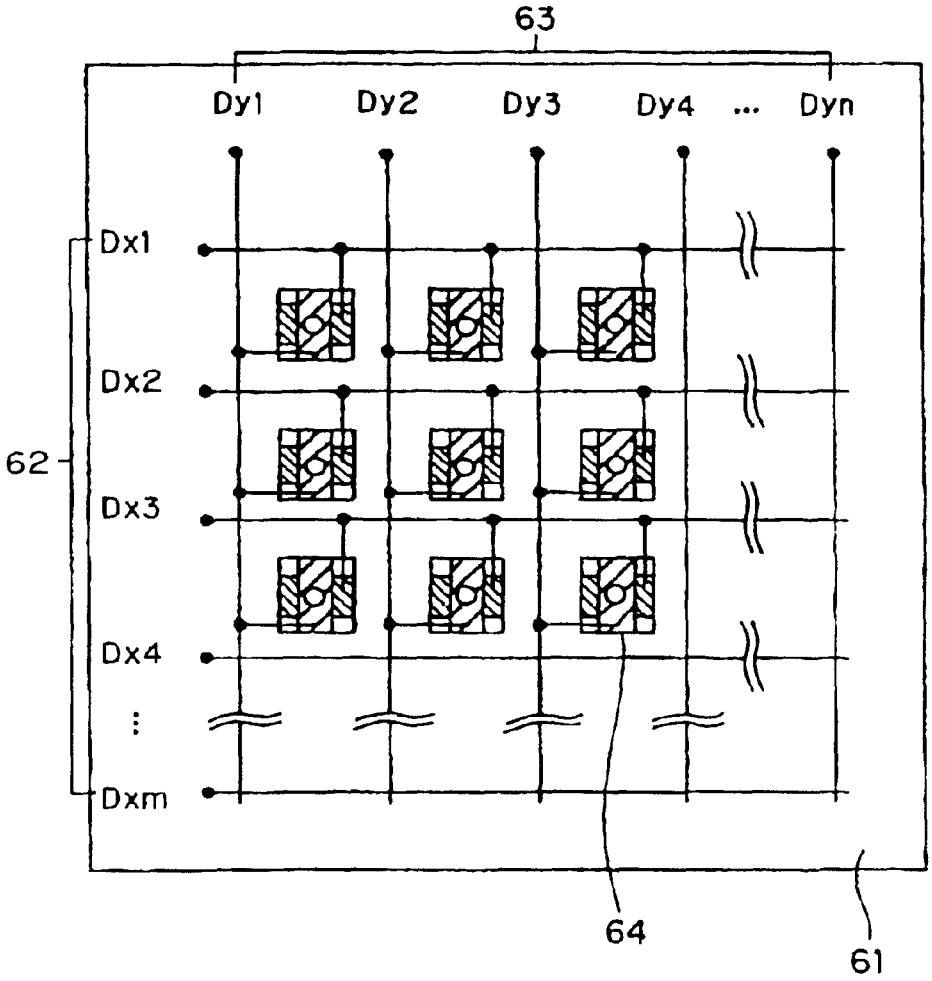
FIG. 12 is a simplified construction diagram showing an electron-emitting device having a passive matrix arrangement that is applicable to the present invention.

FIGS. 4A and 4B are schematic diagrams showing an ON state and an OFF state when the electron-emitting devices of the present invention are arranged in a matrix manner as shown in FIG. 12, and are subjected to matrix driving (line-sequential driving). Note that in the following example, there will be described a case where scanning wiring 62 includes Dx1 to Dx10 and the signal wiring 63 includes Dy1 to Dy10.

FIG. 4A is a plan view schematically showing a display image realized with the driving method of the present invention. The following description will be made by taking, as an example, a case where the electron-emitting devices are arranged in a 10 by 10 matrix manner. However, even if the number of pixels (the number of electron-emitting devices) is further increased, it is possible to use the present invention. In this drawing, there is shown an example where the electron-emitting device at each intersection of Dy1 to Dy8 and Dx1 to Dx5 is placed in a halftone state and each intersection of Dy9 and Dx1 to Dx5 is placed in a white state. Other portions are placed in an OFF state. A driving timing chart and its voltage waveform in this example is shown in FIG. 1.

In this example, there are used electron-emitting devices where the thickness of the insulating layer shown in FIG. 2 is set at 1 $\mu$m, an electric field of around $2\times10^5$ V/cm is generated when a voltage of 20 V is applied to a gate electrode, and electrons are emitted. Also, in the example described here, the ON-voltage ($V_{yOn}$) of the signal lines is set at 20 V and the ON-voltage ($V_{xOn}$) of the scanning lines is set at 0 V.

Also, in this example, there is shown a case where the signal lines Dy1 to Dy10 are divided into two groups and are driven. The signal lines Dy1 to Dy5 constitute a first group and the signal lines Dy6 to Dy10 constitute a second group. The first group is driven prior to the driving of the second group.

In FIG. 1, first, the voltage of the scanning line Dx1 is changed from 20 V corresponding to an OFF state to 0 V corresponding to an ON state. Next, the voltages of the signal lines Dy1 to Dy5 are set at 20 V corresponding to an ON state. Following this, Dy6 to Dy9 are placed in an ON state after a certain time period Δt has passed. After that, a turning-off operation is performed in accordance with an image. That is, first, Dy1 to Dy5 performing halftone display are turned off when the half of one scanning period has passed. When doing so, the potentials of cathode electrodes Dx1 to Dx10 are swung to the negative side by capacity coupling. However, this capacity coupling is capacity coupling with Dy1 to Dy5 and the voltages of Dy6 to Dy10 do not vary, so that the swinging amount is reduced accordingly. Next, after a time difference Δt has passed, Dy6 to Dy8 are placed in an OFF state and the cathode potential is swung to the negative side by the capacity coupling during this operation. Finally, Dy9 is turned off when the one scanning line time period has passed and then Dx1 is given an OFF-voltage.

Next, Dx2 is changed to an ON state and driving that is the same the driving performed for Dx1 is performed. This operation will be repeated in succession until the operation is performed for Dx10 (line-sequential driving is performed) thereby obtaining one field.

Figure 16:
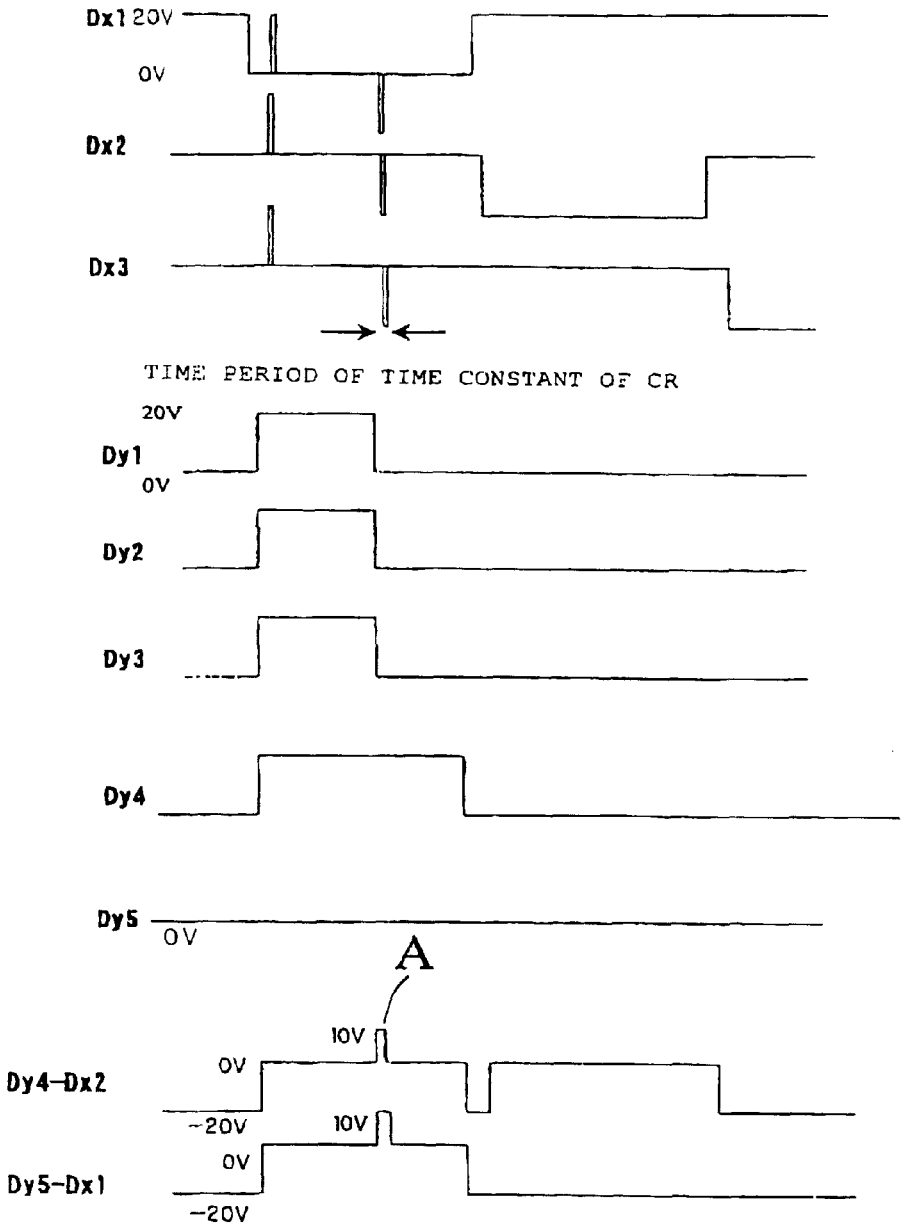
FIG. 16 is a timing chart showing the example of the conventional image-forming apparatus driving method.

With the driving method described with reference to FIG. 16, there may be a case where light emission is performed at the intersections of Dx6 to Dx10 and Dy9 and there occurs light emission in a vertical line manner, as shown in FIG. 4B. However, with the driving method of the present invention, it becomes possible to principally suppress such light emission, which makes it possible to suppress a phenomenon that lowers contrast.

A general numerical example will be shown below.

In the following description, it is assumed that the total number of the scanning lines is referred to as m, the total number of the signal lines is referred to as n, the ON-voltage and OFF-voltage of the scanning lines are respectively referred to as $V_{xOn}$ and $V_{xOff}$ the ON-voltage and OFF-voltage of the signal lines are respectively referred to as $V_{yOn}$ and $V_{yOff}$, the capacity at each intersection of the signal lines and the scanning lines is referred to as Cd, the parasitic capacitance of the scanning lines is referred to as Cpx, the parasitic capacitance of the signal lines is referred to as Cpy, the number of groups, into which the signal lines are divided, is referred to as N, and the number of signal lines constituting a group obtained by the division is referred to as P. In this case, when all the signal lines constituting a group are shifted from an ON state to an OFF state, voltage dropping to be described below momentary occurs to the scanning lines due to the capacity coupling.

$$\delta V=(V_{voff}-V_{yon})\times^{(P\times Cd)}/(Cpx+n\times Cd) \quad \text{(Expression 1)}$$

If the signal lines are evenly divided into N groups, NP=n and P=n/N. Consequently, it is important that δ V becomes 1/N in comparison with a case where the division is not performed. Even if N=2, δV becomes ½, so that it can be seen that the technique of the present invention is highly effective in suppressing δV.

In the case where the threshold voltage during electron emission that is the most critical is set at Vth, a condition that needs to be satisfied at intersections of the signal lines under the ON state and the scanning lines under the OFF state is that the voltage ($=|V_{yOn}-V_{xOff}|-\delta V$, which applied to each device is below Vth. It is possible to satisfy this condition by reducing δV, that is, by setting N at two or higher instead of one in view of the reason described above.

However, if N is increased, this leads to an increase of a time difference between the driving of one group and the driving of another group, so that a time loss calculated from an expression "the time difference×N" becomes unavoidable. Consequently, it is required to reduce the time corresponding to one bit during the light emission for one frame, which leads to the increase of power consumption due to the reduction of brightness or the increase of each voltage (gate, cathode, and anode) to prevent the lowering of brightness. In particular, it is not preferable that the number of scanning lines is increased and the number of pixels is increased. It is appropriate that N takes a value of from 2 to 10. In particular, it is preferable that N is set at 3. This is because it becomes possible to realize this condition by dividing the signal lines for each of RGB and this is also preferable from the viewpoint of the designing of a driving circuit.

Further, needless to say, it is preferable that the time difference between the driving of respective groups is elongated as much as possible because it becomes possible to eliminate effects on driving systems for respective groups. However, there are imposed limitations on this elongation for the same reasons as above. If the time difference is equal to or more than CR of the scanning lines, a disturbance due to the driving of one group almost subsides and there is suppressed a situation where the disturbances of respective groups overlap each other and δV is increased. Accordingly, it is ideal that the time difference is almost equal to CR (effectively, CR±10%). Consequently, it is enough that the time difference is equal to or more than 0.9×CR. Also, in this description, explanation has been made by assuming that the scanning lines are cathodes and the signal lines are gates. However, needless to say, it is possible to similarly cope with an opposite case, that is, a case where the scanning lines are gates and the signal lines are cathodes. The present invention is not limited to the above description.

Also, as to the Cpx described above, the capacities with adjacent scanning lines are predominant and it is conceived that there additionally exist capacities with anodes, capacity with a groundwork substrate, and the like. In areas other than a display area, there exist layers other than the cathodes having fixed potentials, a capacity at an output buffer (this capacity is almost negligible in comparison with the capacitance within the display area), and the like. It is possible to obtain the Cd described above based on a cross-sectional image (an SEM image, for instance) of a pixel portion from a basic expression "$Cd=\epsilon_0\times\epsilon\times S/d$" ($\epsilon_0$ is a dielectric constant in a vacuum space, ε is a specific inductive capacity of a material between the scanning lines and the signal lines, S is an area in which the scanning lines and the signal lines overlap each other, and d is a distance between the scanning lines and the signal lines). However, it is enough that a fringe effect that is a deviation from parallel flat plate or the like is calculated from its shape and is multiplied by a coefficient. On the other hand, it is possible to obtain a total capacity C from C=Q/V, for instance, by fixing all potentials of scanning lines and signal lines other than the scanning lines, whose capacities should be obtained, and by measuring Q by applying an AC voltage to the scanning lines, whose capacities should be obtained, at a specific frequency. Then, it is possible to obtain a value obtained from C-nCd as the parasitic capacitance Cpx of the scanning lines.

In each electron-emitting device that is preferably applicable to the present invention, a flat electric field with less deformation is formed between the electron-emitting layer 5 and the anode electrode 7, so that the increase of an electron beam diameter is suppressed and therefore it is possible to realize a small electron beam diameter.

Further, the devices of the present invention have a very simple construction where the lamination of a component is repeatedly performed. This means that the manufacturing process is simple and therefore yields are improved during the manufacturing.

FIG. 5 shows a general method of manufacturing the electron-emitting devices described above.

An example method of manufacturing the electron-emitting devices that are applicable to the present invention will be described below with reference to FIGS. 5A to 5F.

Figure 5A:
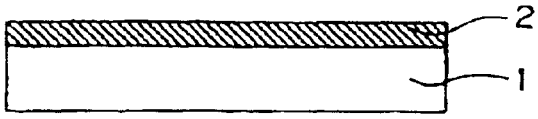
FIGS. 5A to 5F show an example of a method of manufacturing the electron-emitting device that is applicable to the present invention.

As shown in FIG. 5A, the substrate 1 can use one of quartz glass, glass in which the amount of impurities like Na is reduced, soda lime glass, a lamination member configured by laminating $SiO_2$ film on a silicon substrate, or the like. An insulating substrate such as ceramics and alumina can also be used as the substrate 1. Then, the cathode electrode 2 is laminated on the substrate 1.

In general, the cathode electrode 2 has conductivity and is formed with a general technique, such as a vapor deposition method or a sputtering method, or a photolithography technique. The material of the cathode electrode 2 is, for instance, appropriately selected from a group consisting of metals (such as Be, Mg, Ti, Zr, Hf, V, Nb, Ta, Mo, W, Al, Cu, Ni, Cr, Au, Pt, and Pd), their alloys, a carbide (such as TiC, ZrC, HfC, TaC, SiC, and WC), a boride (such as $HfB_2$, $ZrB_2$, $LaB_6$, $CeB_6$, $YB_4$, and $GdB_4$), a nitride (such as TiN, ZrN, and HfN), a semiconductor (such as Si and Ge), amorphous carbon, graphite, diamond like carbon, carbon or a carbon compound in which diamond is dispersed, and the like. The thickness of the cathode electrode 2 is set in a range of from several ten nm to several mm, and preferably in a range of from several hundred nm to several $\mu$m.

Figure 5B:
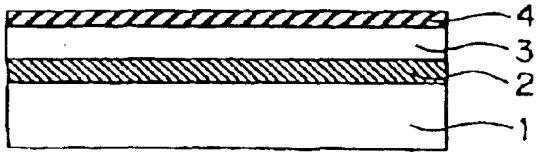

Next, as shown in FIG. 5B, the insulating layer 3 is deposited on the cathode electrode 2. The insulating layer 3 is formed with a general technique, such as a sputtering method, a CVD method, or a vacuum deposition method. The thickness of the insulating layer 3 is set in a range of from several nm to several $\mu$m, and preferably in a range of from several ten nm to several hundred nm. It is preferable that the insulating layer 3 is made of a material, such as $SiO_2$, SiN, $Al_2O_3$, or CaF, that has a high withstand voltage and is resistant to a high electric field.

Further, the gate electrode 4 is deposited on the insulating layer 3. Like the cathode electrode 2, the gate electrode 4 has conductivity and is formed with a general technique, such as a vapor deposition method or a sputtering method, or a photolithography technique. The material of the gate electrode 4 is, for instance, appropriately selected from a group consisting of metals (such as Be, Mg, Ti, Zr, Hf, V, Nb, Ta, Mo, W, Al, Cu, Ni, Cr, Au, Pt, and Pd), their alloys, a carbide (such as TiC, ZrC, HfC, TaC, SiC, and WC), a boride (such as $HfB_2$, $ZrB_2$, $LaB_6$, $CeB_6$, $YB_4$, and $GdB_4$), a nitride (such as TiN, ZrN, and HfN), a semiconductor (such as Si and Ge), an organic polymeric material, and the like. The thickness of the gate electrode 4 is set in a range of from several nm to several ten $\mu$m, and preferably in a range of from several nm to several hundred nm.

It should be noted here that it does not matter whether the electrodes 2 and 4 are made of the same material or different materials. Also, it does not matter whether these electrodes 2 and 4 are formed with the same method or different methods.

Figure 5C:
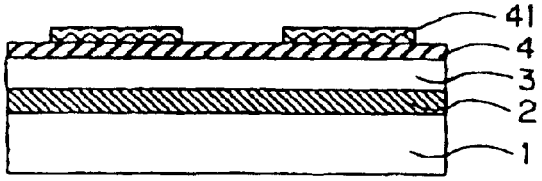

Next, as shown in FIG. 5C, a mask pattern 41 is formed using a photolithography technique.

Figure 5D:
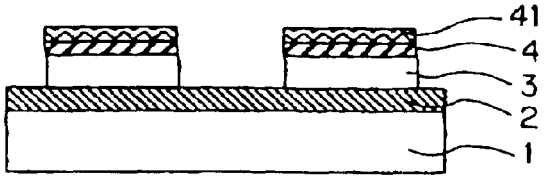

Following this, as shown in FIG. 5D, there is formed a lamination structure where the layers 3 and 4 are partially removed from the cathode electrode 2. Note that it does not matter whether this etching step is terminated before the cathode electrode 2 is also etched or is continued until the cathode electrode 2 is partially etched.

The etching method used in this etching step may be selected in accordance with the materials of the layers 3, 4, and 41.

Figure 5E:
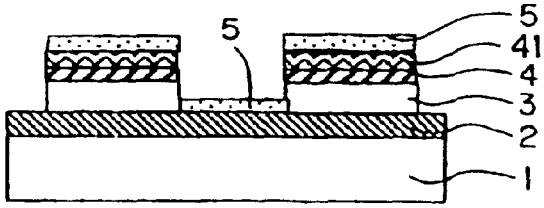

Next, as shown in FIG. 5E, the electron-emitting layer 5 is deposited on the entire surface. The electron-emitting layer 5 is formed using a general technique, such as a vapor deposition method, a sputtering method, or a plasma CVD method. It is preferable that the electron-emitting layer 5 is constructed using a material having a low work function. The material thereof is, for instance, appropriately selected from a group consisting of amorphous carbon, graphite, diamond like carbon, carbon or a carbon compound in which diamond is dispersed, and the like. It is preferable that the electron-emitting layer 5 is made of a thin diamond film diamond like carbon, or the like having a lower work function. The thickness of the electron-emitting layer 5 is set in a range of from several nm to several hundred nm, and preferably in a range of from several nm to several ten nm. Also, in the present invention, a layer constructed from a film including a plurality of carbon fibers is also preferably used as the electron-emitting layer 5. As the carbon fibers, there are preferably used carbon nanotubes (fibers that each have a cylindrical graphene that surrounds the axis of a fiber (single-wall carbon nanotubes)), and multi-wall carbon nanotubes (fibers that each have a plurality of cylindrical graphenes that surround the axis of a fiber), or graphitic nano fibers (fibers having graphemes stacked not-parallel to the axial direction of the fibers). Among these carbon fibers, it is particularly preferable that the graphitic nanofibers are used because it becomes possible to obtain large emission currents. Also, the carbon fibers described above include carbon nanocoils whose carbon fibers have a coil shape.

Figure 5F:
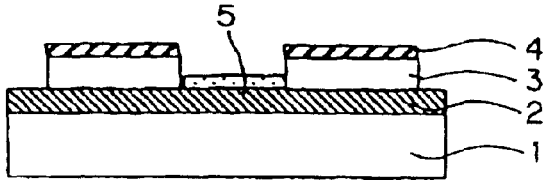

Next, the mask pattern 41 is peeled off as shown in FIG. 5F. In this manner, the electron-emitting device shown in FIG. 1 is manufactured.

The diameter w1 of the hole (opening established in the gate and the insulating layer) shown in FIG. 2 greatly depends on the electron-emitting characteristics of the device and therefore is appropriately determined in accordance with the characteristics of the materials used to construct the device. In particular, the diameter w1 is determined in accordance with the work function and thickness of the electron-emitting layer, the driving voltage of the device, and the required shape of the electron emission beam at that time. In usual cases, the diameter w1 is set in a range of from several hundred nm to several ten $\mu$m.

The shape of the hole is not limited to a specific shape and may be a rectangular shape.

The height h1 of the hole also depends on the electron-emitting characteristics of the device. To apply an electric field that is necessary for electron emission, the height h1 should be appropriately determined in accordance with the thicknesses of the insulating layer and the electron-emitting layer. The height h1 also relates to the shape of an electron beam to be emitted. The height h1 is further a parameter that determines capacities between the scanning lines and the signal lines in a matrix wiring state and is an item that should be designed while establishing matching with other parameters.

Further, there is a case where the pattern of the cathode electrode 2 is obtained, the electron-emitting layer 5 is formed on the entire surface, an etching operation is performed in an etching step, and the etching operation is terminated before the electron-emitting layer 5 is also etched. Also, there is a case where a thin diamond film, diamond like carbon, or the like is selectively deposited at a desired position.

Figure 11A:
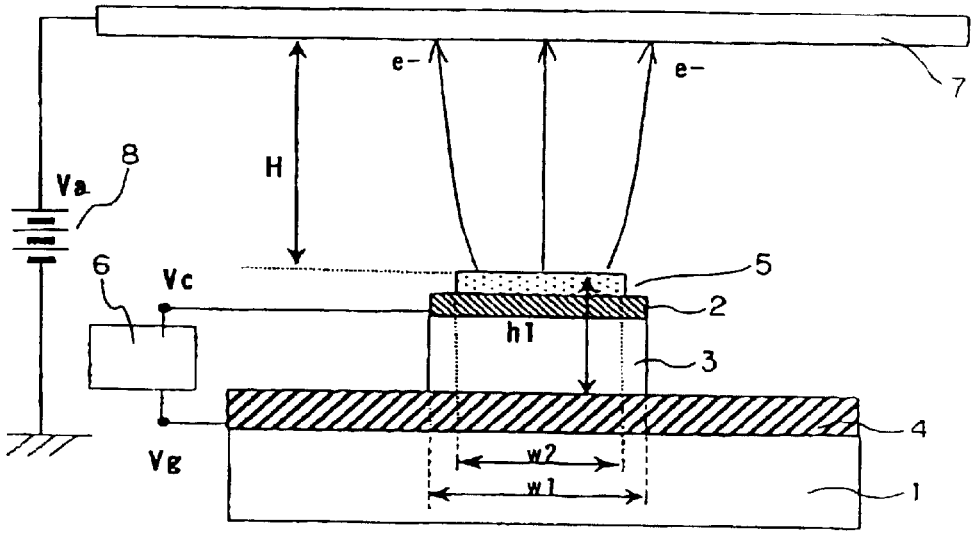
FIGS. 11A and 11B are schematic drawings showing another example of the electron-emitting device that is applicable to the present invention.
Figure 11B:
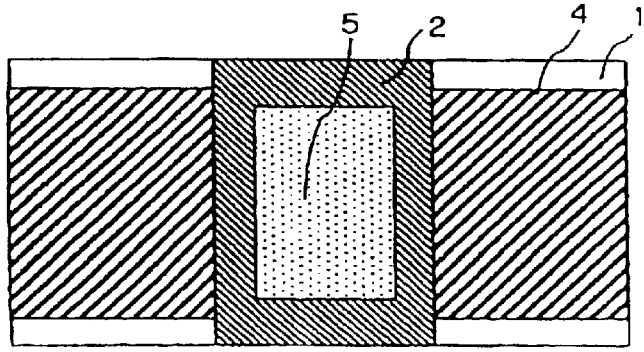

Further, aside from the structure shown in FIGS. 2A, 2B, or other drawings, the present invention is also preferably applicable to an electron-emitting device having a construction shown in FIGS. 11A and 11B where the cathode electrode 2 is arranged above the gate electrode 4 with the insulating layer 3 therebetween. In the case of a form like this, it is preferable that a film including a plurality of carbon fibers as described above are used for the electron-emitting layer 5. It is particularly preferable that graphitic nanofibers are used as the carbon fibers. Also, to suppress a situation where electrons emitted from the electron-emitting layer are irradiated onto the gate electrode 4, it is preferable that the outer region of the electron-emitting layer 5 is provided inside of the outer region of the cathode electrode, as shown in FIGS. 11A and 11B.

Examples of the constructions of an electron source and an image-forming apparatus where a plurality of electron-emitting devices described above are arranged on a substrate in a matrix manner will be described below.

Various manners in which the electron-emitting devices are arranged may be adopted, although it is possible to construct an image-forming apparatus using the passive matrix driving described above, for instance.

Figure 6:
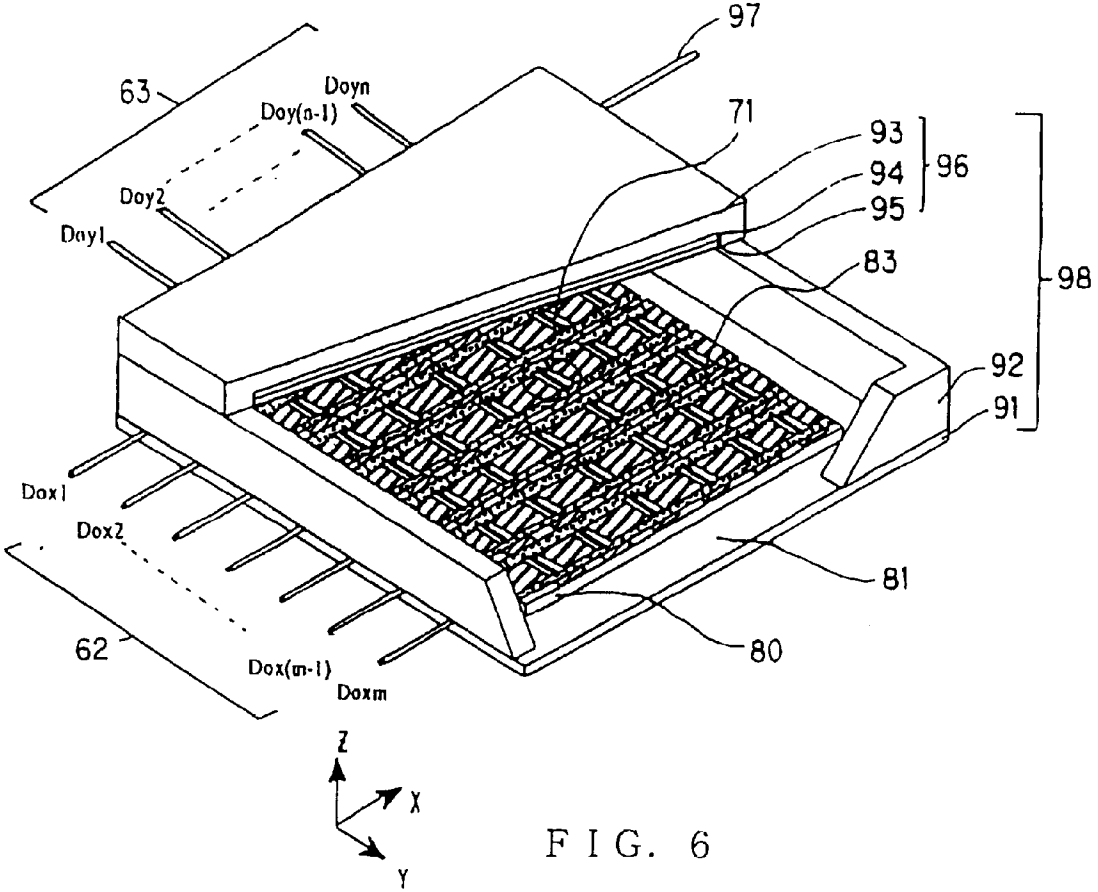
FIG. 6 is a simplified construction diagram showing an image-forming apparatus that uses an electron source having a passive matrix arrangement and is applicable to the present invention.

The above-mentioned construction makes it possible to select respective electron-emitting devices and independently drive the selected devices using passive matrix wiring. An electron source having such a passive matrix arrangement and an image-forming apparatus constructed using the electron source as its driving apparatus will be described below with reference to FIG. 6. This drawing is a schematic diagram showing an example of a display panel of the image-forming apparatus. In FIG. 6, reference numeral 71 represents an electron-emitting device, numeral 81 a substrate of the electron source on which a plurality of electron-emitting devices are arranged, numeral 91 a rear plate to which the electron source substrate 81 is secured, numeral 96 a face plate having a construction where a phosphor film 94, a metal back 95, and the like are formed on the internal surface of a glass substrate 93, and numeral 92 a support frame. The rear plate 91 and the face plate 96 are connected to the support frame 92 using frit glass or the like.

As described above, an envelope (panel) 98 is constructed from the face plate 96, the support frame 92, and the rear plate 91. Because the rear plate 91 is provided to mainly reinforce the strength of the substrate 81, it becomes unnecessary to separately provide the rear plate 91 in the case where the substrate 81 itself has sufficient strength. As a result, the substrate 81 and the rear plate 91 may be formed as a single component.

Frit glass is applied to the connection planes between the face place 96, on whose internal surface there have been provided the phosphor film 94 and the metal back 95, the rear plate 91, and the support frame 92. Then, the face plate 96, the support frame 92, and the rear plate 91 are fixed so that these components are connected at predetermined positions. Finally, the components are heated, baked, and seal-bonded.

It is also possible to adopt various kinds of heating means, such as an infrared ray lamp for performing lamp heating or a hot plate, to perform the baking and seal bonding. Also, the heating means is not limited to these examples.

Also, the bonding material used to heat and bond the plurality of components constituting the envelope is not limited to the frit glass. That is, various kinds of bonding materials may be used so long as a sufficient vacuum atmosphere is formed using the material after the seal bonding step.

The aforementioned envelope is merely an example of the present invention. Therefore, the present invention is not limited to this and various different envelopes may be adopted.

As another example, the support frame 92 may be directly seal-bonded to the substrate 81 to construct the envelope 98 using the face plate 96, the support frame 92, and the substrate 81. Also, by inserting a support member called a spacer (not shown) between the face plate 96 and the rear plate 91, the envelope 98 may be made to be sufficiently strong against the atmospheric pressure.

Figure 7A:
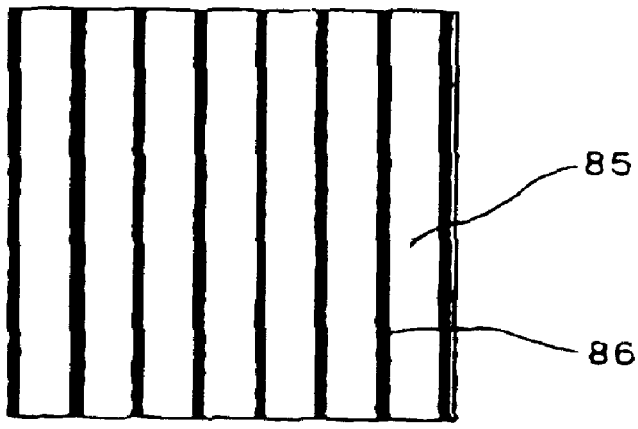
FIGS. 7A and 7B each show a phosphor film in the image-forming apparatus that is applicable to the present invention.
Figure 7B:
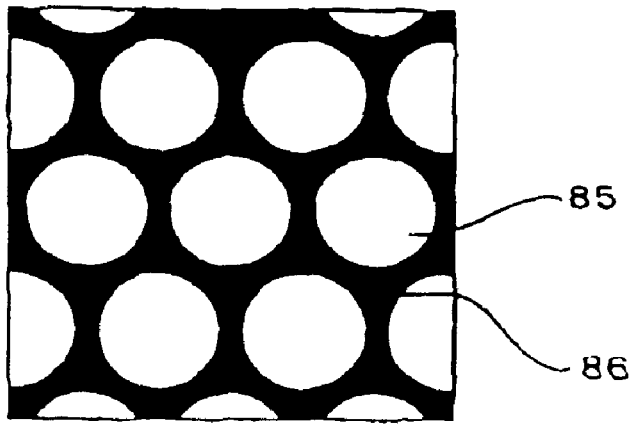

Also, FIGS. 7A and 7B are each a schematic diagram of the phosphor film 94 formed on the face plate 96. The phosphor film 94 is constructed using only a phosphor 85 in the case of monochrome display. In the case of a color phosphor film, the phosphor film 94 may be constructed using a black conductive material 86 called a black stripe or a black matrix and the phosphor 85.

The black stripe or the black matrix is provided to blacken the boundary among respective phosphors 85 for the three primary colors required to display a color image so as to prevent the striking of color mixture or the like and to suppress the lowering of contrast due to the reflection of external light by the phosphor film 94. The material of the black stripe may be a material, whose main ingredient is black lead which is usually used, or any other material so long as the selected material has conductivity and is capable of suppressing light penetration and reflection.

As a method of applying the phosphor to the glass substrate 93, a precipitation method, a printing method, or the like may be employed regardless of whether monochrome display or color display is to be performed. The metal back 95 is usually provided on the internal surface side of the phosphor film 94. The reason why the metal back is provided is to serve as a mirror surface to reflect a light, which travels inward, out of light emitted by the phosphor to the face plate 96 side so as to improve brightness, to act as an electrode for applying a voltage for accelerating electron beams, to protect the phosphor 94 from being damaged by the collision of negative ions generated in the envelope, and the like. The metal back 95 can be formed by subjecting the inner surface of the phosphor to a smoothing process (usually called "filming") after the phosphor film has been formed, and then by depositing Al using a vacuum evaporation method or the like.

The face plate 96 may be provided with a transparent electrode (not shown) on the outer surface of the phosphor film 94 to further improve the conductivity of the phosphor film 94.

With the technique of the present invention, the electron-emitting device 71 emits an electron beam upward at a right angle, so that the phosphor film 94 is positioned and constructed so that this film is arranged directly above the electron-emitting device 71.

Next, there will be described a vacuum sealing step for sealing the envelope (panel) that has been subjected to the seal bonding step.

In the vacuum sealing step, the envelope (panel) 98 is heated and the temperature thereof is maintained at 80 degrees centigrade to 250 degrees centigrade. Under this condition, air in the device is exhausted by an exhaust apparatus, such as an ion pump or an absorption pump, through an exhaust pipe (not shown) to obtain an atmosphere in which organic substances are sufficiently decreased. Then, the exhaust pipe is heated by a burner. As a result, the exhaust pipe is melted, sealed, and cut. To maintain the degree of vacuum after the envelope 98 has been sealed, getter processing may be performed. The getter processing is processing for forming an evaporated film by heating a getter arranged at a predetermined position (not shown) in the envelope 98 by resistance heating, or heating that uses high-frequency heating or the like performed immediately before or after the envelope 98 has been sealed. In usual cases, the getter mainly contains Ba or the like to form the evaporated film that has adsorption effect to maintain the atmosphere in the envelope 98.

Figure 8:
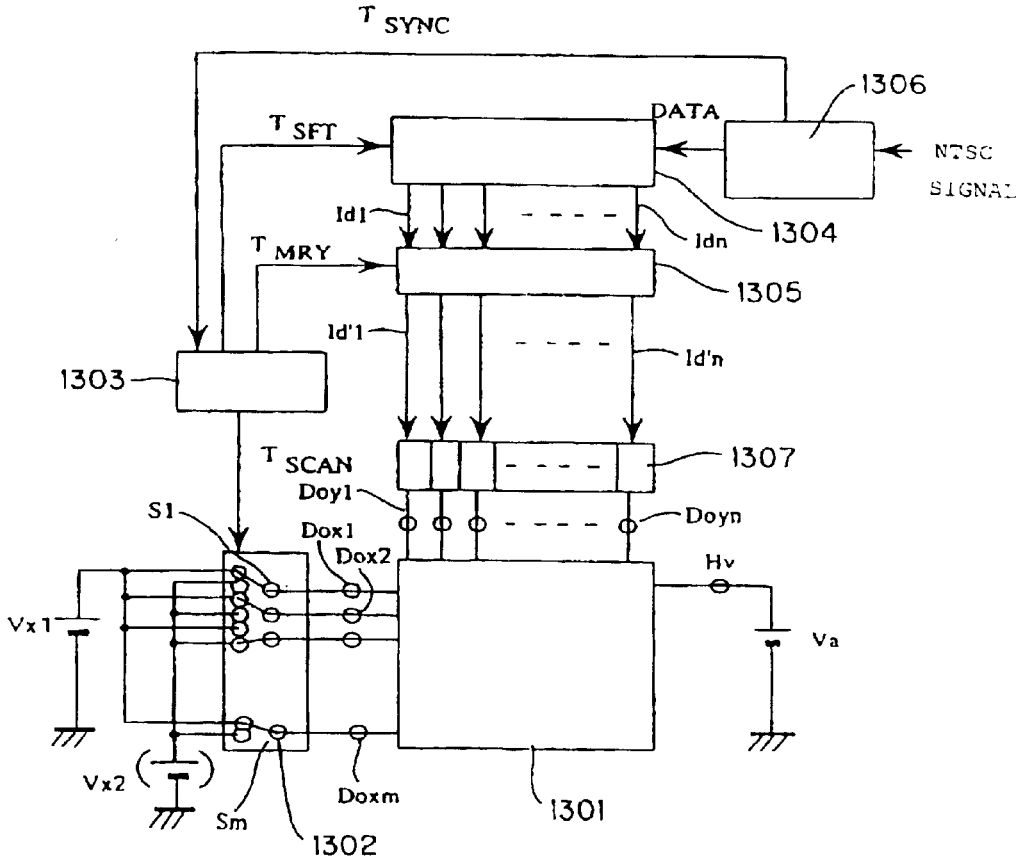
FIG. 8 is a block diagram showing an overall construction of the image-forming apparatus according to the present invention.

In an image-forming apparatus constructed using the passive matrix configuration electron source manufactured in the manner described above, a voltage is applied to each electron-emitting device via external terminals Dx1 to Dxm and Dy1 to Dyn, as shown in FIG. 8. By this voltage application, electron emission is performed.

A high voltage is applied to the metal back 95 or the transparent electrode (not shown) via a high voltage terminal 97 to accelerate an electron beam.

The accelerated electrons collide against the phosphor film 94. As a result, light emission is performed and an image is formed.

FIG. 8 is a block diagram showing an example of a driving circuit (driving apparatus) for performing a display operation in accordance with an NTSC television signal.

A scanning circuit 1302 functioning as a scanning means will be described below. This circuit includes M switching devices (schematically shown in the drawing as S1 to Sm). Each of the switching devices selects one of the output voltages from a DC voltage source Vx1 and a power source Vx2 and is electrically connected to one of the terminals Dx1 to Dxm of a display panel 1301. Each of the switching devices S1 to Sm operates based on a control signal Tscan outputted from a control circuit 1303. For instance, the switching devices can be constructed by combining switching elements such as FETs.

In this example, the DC voltage sources Vx1 and Vx2 are set based on the characteristics of the aforementioned electron-emitting devices that are applicable to the present invention.

The control circuit 1303 has a function of establishing matching between operations of respective portions so that an appropriate display operation is performed based on an image signal inputted from the outside. On the basis of a synchronizing signal Tsync sent from a synchronizing-signal separation circuit 1306, the control circuit 1303 generates respective control signals Tscan, Tsft, and Tmry and supplies these control signals to respective portions.

The synchronizing-signal separation circuit 1306 is a circuit for separating an NTSC television signal inputted from the outside into a synchronizing signal component and a brightness signal component. It is possible to construct this circuit using a general frequency separation (filter) circuit or the like. The synchronizing signal separated by the synchronizing-signal separation circuit 1306 consists of a vertical synchronizing signal and a horizontal synchronizing signal. To simplify the description, however, the synchronizing signal is illustrated as a Tsync signal. Also, the brightness signal component of an image separated from the television signal is expressed as a DATA signal for ease of explanation. The DATA signal is inputted into a shift register 1304.

The shift register 1304 serial/parallel-converts the DATA signal serially inputted in a time series manner for each line of an image, and operates based on the control signal Tsft supplied from the control circuit 1303 (that is, the control signal Tsft may be regarded as a shift clock signal for the shift register 1304). Data for one line of the image (corresponding to data for driving N electron-emitting devices), which has been serial/parallel converted, is outputted from the shift register 1304 as N parallel signals Id1 to Idn.

A line memory 1305 is a storage device for storing, for a required time, data for one line of the image. The line memory 1305 stores contents of Id1 to Idn in accordance with the control signal Tmry sent from the control circuit 1303 as appropriate. The stored contents are outputted as Id'1 to Id'n and are inputted into a modulation signal generator 1307. Further, the signal lines are divided into a plurality of groups by this control signal and are controlled so that the contents are outputted while maintaining time differences.

The modulation signal generator 1307 functioning as a signal line driving means is a signal source for appropriately driving and modulating each electron-emitting device of the present invention in accordance with each of image data Id'1 to Id'n. Output signals from the modulation signal generator 1307 are applied, through the terminals Doyl to Doyn, to the electron-emitting devices of the present invention in the display panel 1301.

In the case where a pulse-shaped voltage is applied to the electron-emitting devices, even if there is applied a voltage that is equal to or lower than an electron emission threshold value, for instance, no electron is emitted. However, in the case where a voltage equal to or higher than the threshold value is applied, an electron beam is outputted. By changing the peak value Vm of the pulse during this operation, it becomes possible to control the intensity of the electron beam to be outputted. Also, by changing the width Pw of the pulse, it becomes possible to control the total quantity of electric charges of the electron beam to be emitted. Further, by combining Vm and Pw described above, it becomes possible to simultaneously control the intensity of the electron beam to be outputted and the total quantity of electric charges of the electron beam.

Accordingly, the electron-emitting device can be modulated in accordance with an input signal using a voltage modulation method, a pulse-width modulation method, or the like. In the case where the voltage modulation method is employed, the modulation signal generator 1307 may be a circuit of a voltage modulation type that generates a voltage pulse having a constant length and appropriately modulates the peak value of the pulse in accordance with the inputted data. Note that the present invention is particularly effective in the case of the pulse-width modulation method or a modulation method that partially adopts the voltage modulation method using the pulse-width pulse method as a basic method.

In the case where the pulse-width modulation method is employed, the modulation signal generator 1307 may be a pulse-width modulation circuit that generates a voltage pulse having a constant peak value and appropriately modulates the width of the voltage pulse in accordance with the inputted data.

The shift register 1304 and the line memory 1305 may be of a digital signal type or an analog signal type so long as it is possible to perform the serial/parallel conversion and storage of an image signal at a predetermined speed.

In the case where the digital signal type components are employed, the output signal DATA from the synchronizing-signal separation circuit 1306 must be converted into a digital signal. It is possible to perform this conversion by providing an A/D converter for the output portion of the synchronizing-signal separation circuit 1306. In relation to the foregoing structure, the circuit to be provided for the modulation signal generator 1307 is somewhat changed depending on whether the output signal from the line memory 1305 is a digital signal or an analog signal. That is, in the case of the voltage modulation method using a digital signal, a D/A conversion circuit or the like is used for the modulation signal generator 1307, and an amplifying circuit and the like are added as necessary. In the case of the pulse-width modulation method, the modulation signal generator 1307 is constructed using a circuit formed by combining, for instance, a high-speed oscillator, a counter for counting the number of waves outputted from the oscillator, and a comparator for comparing an output value from the counter and an output value from the aforementioned memory. As the need arises, an amplifier may be added which amplifies the voltage of the modulation signal, which has been outputted from the comparator and whose pulse width has been modulated, to the level of the voltage for driving the electron-emitting device of the present invention.

In the case of the voltage modulation method using an analog signal, an amplifying circuit including an operational amplifier or the like may be employed as the modulation signal generator 1307. As the need arises, a level shift circuit or the like may be added. In the case of the pulse-width modulation method, a voltage control oscillation circuit (VCO) may be employed, for instance. As the need arises, an amplifier may be added which amplifies the voltage to the level of the voltage for driving the electron-emitting device of the present invention.

The structure of the image-forming apparatus described above is merely an example of the image-forming apparatus to which the present invention is applicable. Therefore, various modifications may be made based on the technical principals of the present invention. Although the NTSC input signal has been described, the input signal is not limited to this signal. Another method, such as PAL or SECAM, may be employed. Another television signal method using further large number of scanning lines (for example, a high-quality television method typified by the MUSE method) may be employed.

Also, aside from the display apparatus, the image-forming apparatus of the present invention may be used as an image-forming apparatus for an optical printer constructed using a photosensitive drum and the like.

Also, as an electron-emitting device to which the present invention is preferably applicable, there may be cited a field emission type electron-emitting device, an MIM type electron-emitting device, and a surface conduction electron-emitting device, for instance.

(Embodiments)

Embodiments of the present invention will be described in detail below.

(First Embodiment)

FIGS. 2A and 2B are respectively an example plan view and an example cross-sectional view of an electron-emitting device produced with the technique of this embodiment, while FIGS. 5A to 5F show an example method of manufacturing the electron-emitting device of this embodiment. The steps for manufacturing the electron-emitting device of this embodiment will be described in detail below.

(Step 1)

First, as shown in FIG. 5A, the substrate 1 is prepared by sufficiently cleaning quartz. Following this, with a sputtering method, a W film having a thickness of 500 nm is formed as the cathode electrode 2.

(Step 2)

Next, as shown in FIG. 5B, an $SiO_2$ film having a thickness of 600 nm is first deposited as the insulating layer 3 and then a Ti film having a thickness of 100 nm is deposited as the gate electrode 4.

(Step 3)

Then, as shown in FIG. 5C, a photomask pattern of a positive photoresist (AZ1500 manufactured by Clariant) is formed by spin coating, and is exposed to light and developed with a photolithography method to form a mask pattern 41.

(Step 4)

As shown in FIG. 5D, dry etching is performed using $CF_4$ gas from above of the mask pattern 41 functioning as a mask, so that the Ta gate electrode 4 and the insulating layer 3 are each etched. This etching operation is terminated before the cathode electrode 2 is also processed. In this manner, a circular hole, whose width w1 is 3 $\mu$m, is formed.

(Step 5)

Following this, as shown in FIG. 5E, a film of diamond like carbon having a thickness of around 100 nm is deposited as the electron-emitting layer 5 on the entire surface with a plasma CVD method. $CH_4$ gas is used as the reaction gas.

(Step 6)

As shown in FIG. 5F, the mask pattern 41 is completely removed to obtain the electron-emitting device of this embodiment.

In this device, the height h1 of the hole becomes 2 $\mu$m.

As shown in FIG. 1, the thus-manufactured electron-emitting device is arranged so that a distance H of 2 mm is maintained and the driving shown in FIG. 1 is performed. During this driving, the voltages Va, $V_{xOn}$, $V_{xOff}$, $V_{yOn}$, and $V_{yOff}$ are set at 10 kV, 0 V, 20 V, 20 V, and 0 V, respectively. In this example, the scanning lines are set as cathodes, the signal lines are set as gates, and modulation is performed on the signal line side. The number of groups, in to which the lines are divided, is set at two. Also, because QVGA pixels are used, the number of pixels is set at a QVGA level that is 320 (for each of RGB, 960 in total) by 240. though, in this example, the signal lines are arranged so as to correspond to RGB pixels, so that the total number of the signal lines becomes 960. As to capacities, the overlapping capacity of the scanning lines and the signal lines is 0.75 pF, and the capacity formed by the overlapping of the signal lines and the scanning lines constitutes 80% of the total capacity of the scanning lines. When all signal lines in one group are changed by 20 V, voltage dropping of 10 V×0.8=8 V occurs to each scanning line. As to the time difference between these two groups, the total capacity of the scanning lines is $1\times10^{-9}$ F, the resistance is 100Ω, and CR is 0.1 $\mu$s. Because the device performs 64-step gradation display and one bit corresponds to around 1 $\mu$s, the time difference is set as 1 $\mu$s, which corresponds to one bit. In this embodiment, even if the voltages of the scanning lines drop by 8 V, the voltage applied to the electron-emitting device becomes 20−20+8=8 V and this device remains turned off. When the signal lines are driven at the same time, the degree of the voltage dropping is doubled and becomes 16 V. As a result, the voltage applied to the electron-emitting device becomes 16 V and the lowering of contrast is observed in portions that are originally black. In contrast to this, when the driving of this embodiment is performed, the electron emission current Ie during an OFF period becomes 1/100 or lower of that during an ON period and it has been confirmed that the phosphor emits no light.

In this embodiment, there has been described a case where the lines are divided into two groups. However, the present invention is not limited to this as described above in the embodiment mode. That is, the lines may be divided into three or four groups. Also, it is not required that each group includes the same number of signal lines. That is, it does not matter whether respective groups include the same number of signal lines or include different numbers of signal lines.

Also, the present invention is not limited to the above description. That is, it is also possible to have signal lines of only certain groups operate during one scanning period, to have other groups operate during the next frame, thereby suppressing the disturbance by the signal lines affecting the scanning lines. However, in this case, light emission is not performed by all of pixels during one frame, so that there occurs degradation in image quality to some extent. Therefore, this case is similarly applicable to an application purpose where such an image is acceptable and it is possible to use the driving method of the present invention.

(Second Embodiment)

Figure 9:
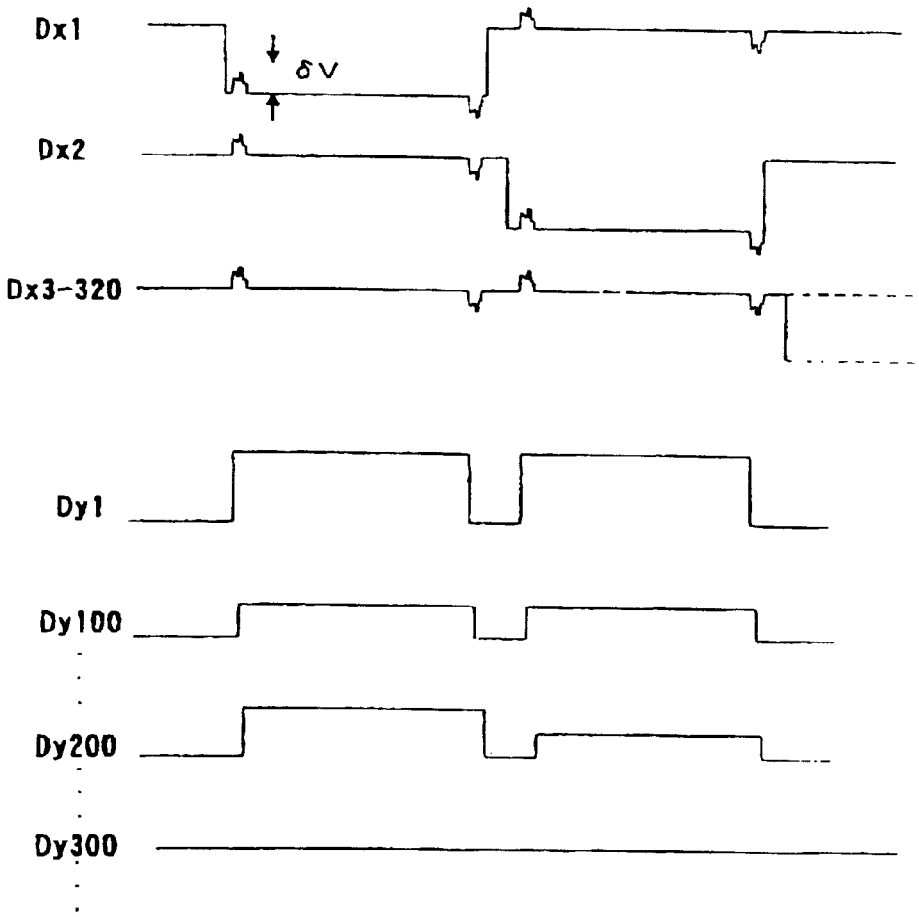
FIG. 9 is a timing chart illustrating an electron-emitting device driving method according to a second embodiment of the present invention.

In the second embodiment of the present invention, another driving method of the present invention will be described. In this embodiment, analog gradation display is performed instead of time gradation display. A timing chart in this case is shown in FIG. 9. Because the analog gradation is used, the potential of each signal line is not maintained constant and its potential value is changed in accordance with gradation. In this embodiment, there will be described a case where the signal lines are divided into four groups and driving is performed. In the case of batch driving, a common ON timing and a common OFF timing are used for all signal lines regardless of the gradation. As a result, the disturbance of a voltage obtained from the following expression rides on each cathode that is a scanning line.

$$\delta V = \sum_{i=1}^{M} \{(V_{yI}) \times (Cd)\} / (Cpx + M \times Cd) \quad \text{(Expression 2)}$$

Here, M is the total number of signal lines. The voltage becomes positive at the ON timing and becomes negative at the OFF timing.

The lowering of contrast is caused by this disturbance as described in the first embodiment. However, when the signal lines are divided into four groups, the disturbance becomes as expressed by the following expression.

$$\delta V = \sum_{i=1}^{M/4} \{(V_{yI}) \times (Cd)\} / (Cpx + M \times Cd) \quad \text{(Expression 3)}$$

As a result, as shown in FIG. 9, although respective values differ from each other, the absolute value of δV becomes small. Also, although a disturbance time is elongated, the effect on the electron-emitting device is reduced. That is, this disturbance occurs four times each for positive and negative voltages of each scanning line. However, the absolute value of δV becomes small, so that each electron-emitting device under an OFF state does not emit light. This means that there is obtained the same significant effect as in the first embodiment. That is, the lowering of contrast is prevented and a good-quality image is obtained.

(Third Embodiment)

Figure 10:
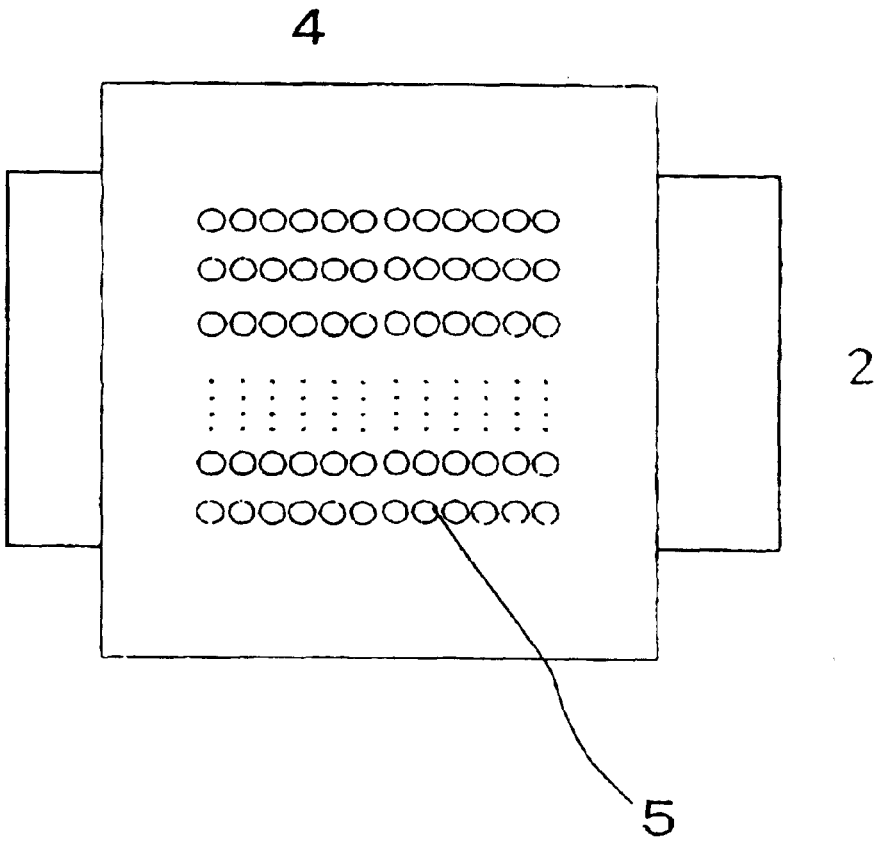
FIG. 10 shows a basic construction of an electron-emitting device that is applicable to the present invention.

Next, there will be described the third embodiment of the present invention. The first and second embodiments have been described with reference to drawings in which one electron-emitting device exists at each intersection of the scanning lines and the signal lines. However, in this embodiment, as shown in FIG. 10, a plurality of electron-emitting devices are formed for each pixel. To realize this construction, the area of each intersection of the scanning lines and the signal lines is increased and an area, in which electron emission is performed, is also increased. Accordingly, it becomes possible to enhance the electron-emitting efficiency and to reduce a voltage that is required to obtain a necessary electric field. As a result, it becomes possible to lower power consumption. However, the capacity formed by the signal lines and the scanning lines is increased to around 95% of the total capacity of the scanning lines. When the voltages of all of the signal lines are changed by 20 V, the voltage of each scanning line drops by 19 V. However, when the driving method of the present invention is used and the signal lines are divided into ten groups and are driven, this value is reduced to 1/10 of the original value and there occurs no troublesome disturbance. Consequently, there occurs no malfunction of the electron-emitting device. As a result, it becomes possible to obtain an image with good contrast.

(Fourth Embodiment)

FIGS. 2A and 2B are respectively an example plan view and an example cross-sectional view of an electron-emitting device produced with the technique of this embodiment, while FIGS. 5A to 5F show an example method of manufacturing the electron-emitting device of this embodiment. The steps for manufacturing the electron-emitting device of this embodiment will be described in detail below.

(Step 1)

First, as shown in FIG. 5A, the substrate 1 is prepared by sufficiently cleaning quartz. Following this, with a sputtering method, a W film having a thickness of 500 nm is formed as the cathode electrode 2.

(Step 2)

Next, as shown in FIG. 5B, an $SiO_2$ film having a thickness of 600 nm is first deposited as the insulating layer 3 and then a Ti film having a thickness of 100 nm is deposited as the gate electrode 4.

(Step 3)

Then, as shown in FIG. 5C, a photomask pattern of a positive photoresist (AZ1500 manufactured by Clariant) is formed by spin coating, and is exposed to light and developed with a photolithography method to form a mask pattern 41.

(Step 4)

As shown in FIG. 5D, dry etching is performed using $CF_4$ gas from above of the mask pattern 41 functioning as a mask, so that the Ta gate electrode 4 and the insulating layer 3 are each etched. This etching operation is terminated before the cathode electrode 2 is also processed. In this manner, a circular hole, whose width w1 is 3 μm, is formed.

(Step 5)

Following this, as shown in FIG. 5E, a film of diamond like carbon having a thickness of 100 nm is deposited as the electron-emitting layer 5 on the entire surface with a plasma CVD method. $CH_4$ gas is used as the reaction gas.

(Step 6)

As shown in FIG. 5F, the mask pattern 41 is completely removed to obtain the electron-emitting device of this embodiment.

In this device, the height h1 of the hole becomes 2 μm.

The thus-manufactured electron-emitting device is used as the matrix wiring electron-emitting device shown in FIGS. 11A and 11B, thereby obtaining the image-forming apparatus shown in FIGS. 6 and 8. As to the pixel size, pixels are arranged with a pitch of x=100 μm and y=100 μm and the number of pixels is set at a VGA level. The number of pixels is increased and a time given to one scanning line is reduced to merely around 30 μs and the permissible time for one bit is reduced to as small as 0.1 μs in the case of 256-step gradation display. In this example, the cathodes are formed using tungsten so as to have a thickness of around 1 μm, thereby reducing the resistance and CR of the scanning lines. The CR in this case is 0.05 μs and the time difference between respective groups is set at 0.05 μs that is the same as this CR. Note that the signal lines are divided into two groups. Phosphors as well as an anode electrode are arranged over the device. With this construction, there is obtained a waveform where disturbances of adjacent groups overlap each other, although these disturbances do not overlap at their maximum values. As a result, there is reduced an effect on the electron-emitting device and there are exhibited good characteristics. The contrast is increased to 200 or higher and gradation display is favorably performed. As a result, it is possible to form a high-definition image-forming apparatus.

(Fifth Embodiment)

In this example, an electron-emitting device having a construction that is similar to the construction produced in the fourth embodiment is used as a matrix wiring electron-emitting device shown in FIG. 12, thereby obtaining the image-forming apparatus shown in FIGS. 6 and 8.

As to the pixel size, arrangement is performed with a pitch of x=132 μm and y=44 μm and the number of pixels is set at an XGA level. In this case, the selection time given to one scanning line is reduced to merely around 19 μs. Also, in the case where 256-step gradation display is performed, the permissible time for one LSB is reduced to as small as 0.0742 μs.

In this example, the scanning lines are set as gates, the signal lines are set as cathodes, and modulation is performed on the signal line side. Also, in this example, the signal lines are arranged so as to correspond to RGB pixels, so that the total number of the signal lines becomes 1024×3=3072. The gates are formed using aluminum so as to have a thickness of around 1 μm, thereby reducing the resistance and CR of the scanning lines. The CR in this case becomes 0.05 μs.

Figure 13:
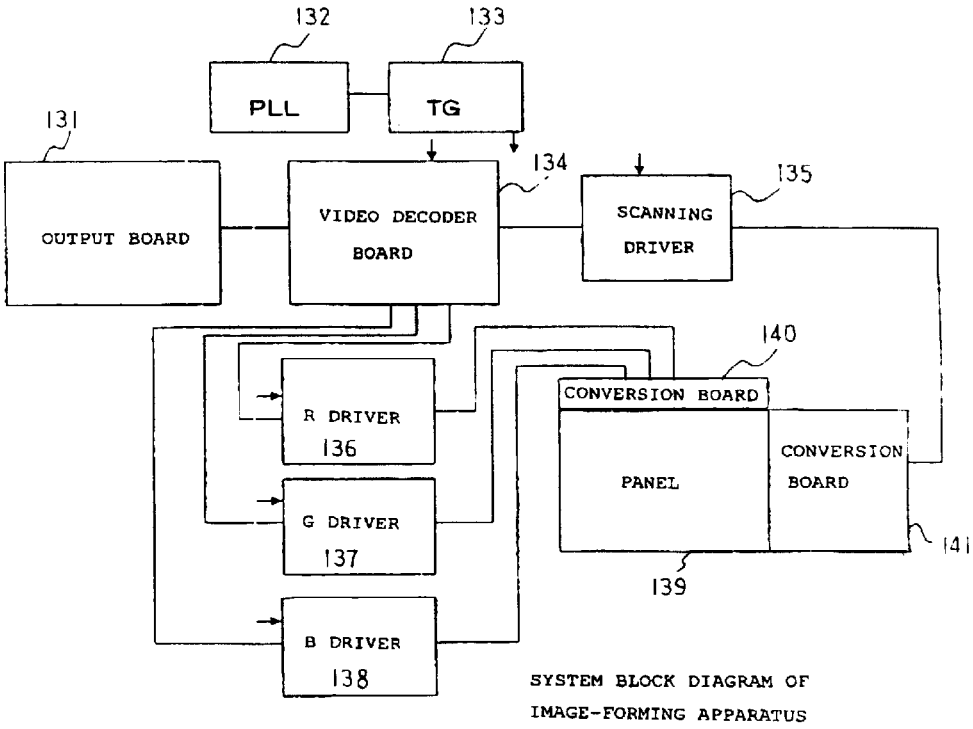
FIG. 13 is a schematic diagram of an example of a driving circuit of the present invention.

FIG. 13 shows a system block diagram of an image forming apparatus produced in this embodiment. A video signal from an output board 131 is first converted from an analog signal to a digital signal by a video decoder board 134. Following this, the digital signal is transmitted to X-directional drivers (drivers for a modulation signal) corresponding to an R-driver 136, a G-driver 137 and a B-driver 138 and Y-directional drivers (drivers for a scanning signal) corresponding to scanning drivers 135 as an 8-bit signal. Then, the X-directional drivers and the Y-directional drivers are driven by timing signals from a PLL 132 and a TG 133, so that the digital signals are respectively converted with conversion boards 140, 141 into a desired signal and is inputted into a panel (image-forming apparatus). Note that arrows directed to the video decoder board 134, the scanning drivers 135, the R-driver 136, the G-driver 137 and the B-driver 138 indicate timing signals outputted from TG 133.

Figure 14:
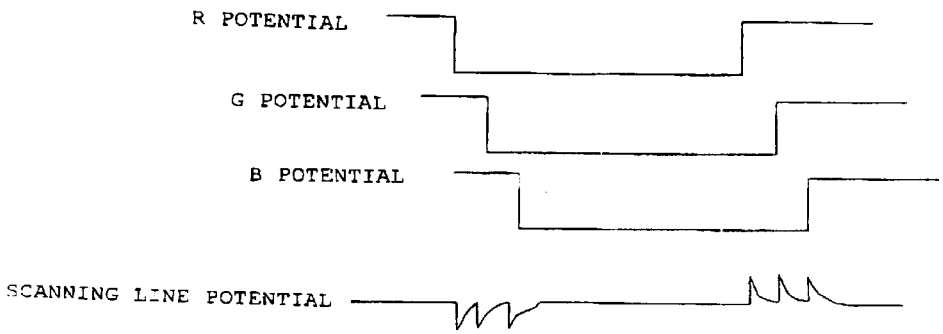
FIG. 14 is a schematic diagram showing a timing chart illustrating an example of the driving method of the present invention.

In this embodiment, the output timings of respective X-directional drivers divided for each of R, G, and B are shifted from each other by 0.05 μs that approximately corresponds to CR, thereby inputting the desired signal to the panel (image-forming apparatus). There exists a time difference of 0.05 μs between the signal lines for R and the signal lines for G and there exists a time difference of 0.05 μs between the signal lines for G and the signal lines for B, so that a timing lag of 0.10 μs corresponding to 2 CR occurs between the signal lines for R and the signal lines for B. A timing chart under an OFF state in this case is shown in FIG. 14. At a point in time when the potentials of the R signal lines are placed in an OFF state, the potentials applied to the signal lines for G and B are not changed. Consequently, by capacity division, voltages of the scanning lines merely vary by ⅓ or less of the voltage variations of the signal lines. With this construction, there is obtained a waveform where disturbances of adjacent groups overlap each other to some extent, although these disturbances do not overlap at their maximum values. As a result, there is reduced an effect on the electron-emitting device and there are exhibited good characteristics. Also, the contrast of a displayed image is increased to 200 or higher and gradation display is favorably performed. As a result, there is formed a high-definition image-forming apparatus.

The X-directional drivers are divided for each of R, G, and B, so that it is enough to generate timing lags therebetween. That is, it is enough that the timings are lagged by one clock or a delay circuit is provided within the drivers, for instance. This means that the load placed on the system is small. Further, if the number of pixels is increased to the XGA level, one scanning period is also shortened. Accordingly, there is a concern that the driving method of the present invention has its problem of the period for one scanning line elongated by the timing lag. However, if the elongating degree is around CR (=0.05 μs) like in this embodiment, there merely occurs a time loss of around 0.1 μs even if the signal lines are divided into three groups. As a result, the permissible time for one LSB becomes 0.738 μs and is approximately the same as 0.742 μs in the case where the signal lines are not divided into groups. This time loss falls within a range where it is possible to perform adjustment using blanking.

(Sixth Embodiment)

Next, there will be described the sixth embodiment of the present invention. An electron-emitting device of this embodiment has a construction where a gate electrode 4, an insulating layer 3, a cathode electrode 2, and an electron-emitting layer 5 are stacked on a substrate 1 in this order, as shown in FIG. 11A. Note that in this embodiment, a film including a plurality of carbon fibers is used as the electron-emitting layer 5. Also, carbon nanotubes are used as the carbon fibers.

Figure 15:
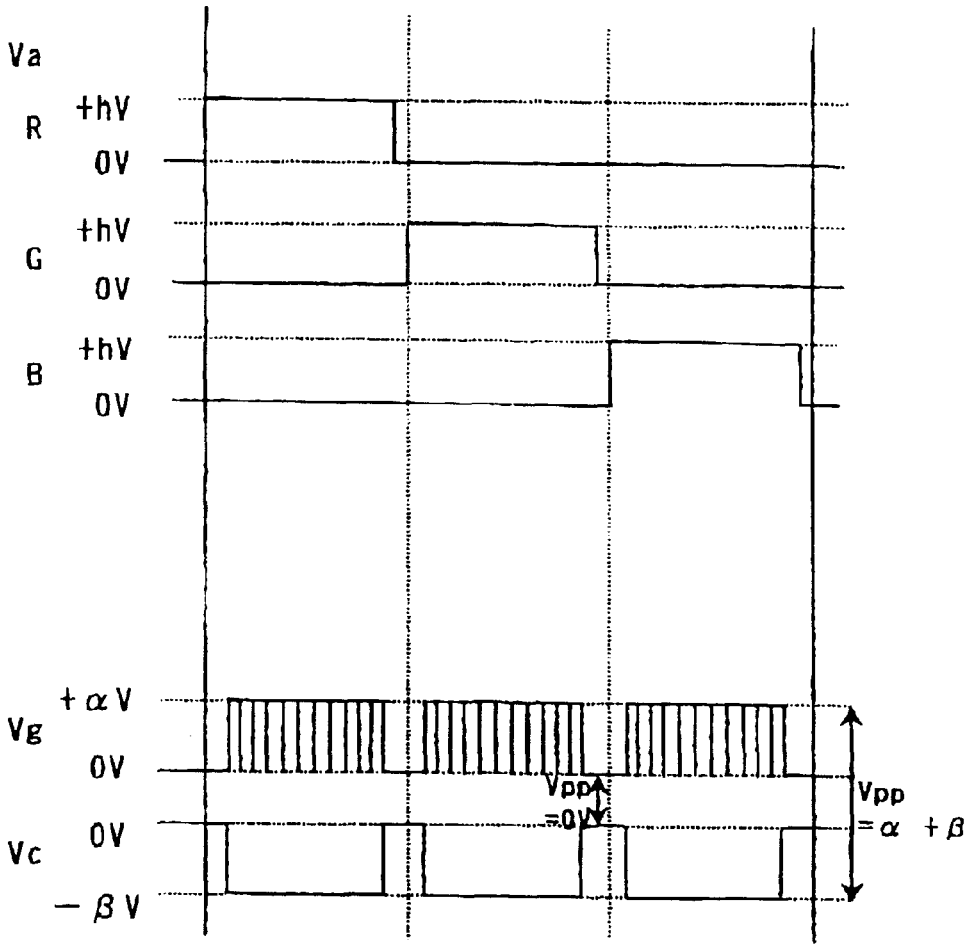
FIG. 15 schematically shows an example of a conventional image-forming apparatus driving method.

The materials and sizes of components of the electron-emitting device are determined in conformance with the first embodiment and w1 is set at 3 μm. However, the film thicknesses of the cathode electrode 2, the insulating layer 3, and the gate electrode 4 are respectively set at 100 nm, 500 nm, and 2 μm. Also, the electron-emitting layer is not arranged on the entire surface above the cathode electrode and its width w2 is set at 2 μm in this embodiment. An electron source is constructed by matrix-arranging the electron-emitting devices of this embodiment using the same construction as in the fifth embodiment. Note that in this embodiment, there is obtained a construction where the cathode electrodes 2 are set as the X-directional wiring (Dx1 to Dxm), the gate electrodes 4 are set as the Y-directional wiring (Dy1 to Dyn), a scanning signal is applied to the X-directional wiring, and a modulation signal is applied to the Y-directional wiring. Then, a face plate, on which phosphors for emitting light in the three primary colors (RGB) have been arranged, is arranged so as to oppose the electron source, thereby forming the image display apparatus shown in FIG. 6. Then, like in the fifth embodiment, modulation signal lines (Dy1 to Dyn) are divided into three groups corresponding to RGB and potentials are applied to respective groups (corresponding to each of RGB) by maintaining a time difference between the application timings of the potentials. The time difference is approximately the same as CR (see FIGS. 15 and 16). Like in the fifth embodiment, the image display apparatus produced in this embodiment is capable of realizing good contrast.

As described above, with the technique of the present invention, when an image display apparatus, which uses an electron source where electron-emitting devices are arranged in a matrix manner, is subjected to line-sequential driving, it becomes possible to maintain good contrast.

Also, when an electron source like this is applied to an image-forming apparatus, it becomes possible to realize an image-forming apparatus having superior performance.

What is claimed is:

1. An electron source driving apparatus for an electron source where a plurality of electron-emitting devices are connected to a plurality of scanning lines and a plurality of signal lines crossing the plurality of scanning lines, comprising:

a scanning means for performing, for all of the plurality of scanning lines in succession, an operation including selection of a desired scanning line out of the plurality of scanning lines, application of a selection signal to the selected scanning line, and application of a non-selection signal to each unselected scanning line; and a signal line driving means for dividing the plurality of signal lines into a plurality of groups and applying a selection signal to the plurality of signal lines so that timings, at which the application of the selection signal to respective groups is started, are shifted from each other, wherein if an electric capacity of the scanning lines is referred to as C and electric resistance of the scanning lines is referred to as R, a time difference that is equal to or more than a value obtained by a multiplication of CR by 0.9 is maintained between the timings at which the application of the selection signal to respective groups is started.

2. An electron source driving apparatus for an electron source where a plurality of electron-emitting devices are connected to a plurality of scanning lines and a plurality of signal lines crossing the plurality of scanning lines, comprising:

a scanning means for performing, for all of the plurality of scanning lines in succession, an operation including selection of a desired scanning line out of the plurality of scanning lines, application of a selection signal to the selected scanning line, and application of a non-selection signal to each unselected scanning line; and a signal line driving means for dividing the plurality of signal lines into a plurality of groups and applying a selection signal to the plurality of signal lines so that timings, at which the application of the selection signal to respective groups is started, are shifted from each other, wherein if an electric capacity of the scanning lines is referred to as C and electric resistance of the scanning lines is referred to as R, a time difference that is equal to or more than CR is maintained between the timings at which the application of the selection signal to respective groups is started.

3. An electron source driving apparatus according to claim 1 or 2, wherein the signal line driving means has a function of driving all of the signal lines while the desired scanning line is being selected.

4. An electron source driving apparatus according to claim 1 or 2, wherein the selection signal that the signal line driving means applies to the signal lines is a potential having a pulse waveform that is a signal having a pulse width modulated in accordance with a gradation of an inputted image signal.

5. An electron source driving apparatus according to claim 1 or 2, wherein the selection signal that the signal line driving means applies is a potential having a pulse waveform that is a signal having a peak value modulated in accordance with a gradation of an inputted image signal.

6. An electron source driving apparatus according to claim 1 or 2, wherein the selection signal is applied by dividing the plurality of signal lines into groups the number of which is in a range of from 2 to 10.

7. An electron source driving method for an electron source where a plurality of electron-emitting devices are connected to a plurality of scanning lines and a plurality of signal lines crossing the plurality of scanning lines, comprising:

performing, for all of the plurality of scanning lines in succession, an operation including selection of a desired scanning line out of the plurality of scanning lines, application of a selection signal to the selected scanning line, and application of a non-selection signal to each unselected scanning line; and dividing the plurality of signal lines into a plurality of groups and, if an electric capacity of the scanning lines is referred to as C and electric resistance of the scanning lines is referred to as R, maintaining a time difference that is equal to or more than a value obtained by a multiplication of CR by 0.9 between respective timings at which the application of the selection signal to respective groups is started.

8. An electron source driving method for an electron source where a plurality of electron-emitting devices are connected to a plurality of scanning lines and a plurality of signal lines crossing the plurality of scanning lines, comprising:

performing, for all of the plurality of scanning lines in succession, an operation including selection of a desired scanning line out of the plurality of scanning lines, application of a selection signal to the selected scanning line, and application of a non-selection signal to each unselected scanning line; and dividing the plurality of signal lines into a plurality of groups and, if an electric capacity of the scanning lines is referred to as C and electric resistance of the scanning lines is referred to as R, maintaining a time difference that is equal to or more than CR between respective timings at which the application of the selection signal to respective groups is started.

9. An electron source driving method according to claim 7 or 8, wherein all of the signal lines are driven during one scanning period.

10. An electron source driving method according to claim 7 or 8, wherein the signal applied to the signal lines is a potential having a pulse waveform that has a pulse width modulated in accordance with a gradation of an inputted image signal.

11. An electron source driving method according to claim 7 or 8, wherein the signal applied to the signal lines is a potential having a pulse waveform that has a peak value modulated in accordance with a gradation of an inputted image signal.

12. An electron source driving method according to claim 7 or 8, wherein the selection signal is applied by dividing the plurality of signal lines into groups the number of which is in a range of from 2 to 10.

13. An electron source driving method according to claim 7 or 8, wherein the plurality of electron-emitting devices are provided at respective intersections of the scanning lines and the signal lines.

14. An image-forming apparatus driving method for an image-forming apparatus including:

an electron source; and an image-forming member that forms an image using electrons emitted from the electron source, wherein an image is formed by driving the electron source with a driving method according to claim 7 or 8.

* * * * *

UNITED STATES PATENT AND TRADEMARK OFFICE

CERTIFICATE OF CORRECTION

PATENT NO. : 6,847,337 B2
DATED : January 25, 2005
INVENTOR(S) : Takeshi Ichikawa It is certified that error appears in the above-identified patent and that said Letters Patent is hereby corrected as shown below:

Title page,
Item [56], References Cited, OTHER PUBLICATIONS,
"Suzuki, M., et al.," reference, "Mim-cathode" should read -- MIM-Cathode --;
"M. Hartwell et al.," reference, "Strong" should read -- "Strong --; and "Films," should read -- Films," --.

Column 1,
Line 31, "Toshiaki. Kusunoki," should read -- Toshiaki Kusunoki, --; and
Line 64, "n lines" should read -- m lines --.

Column 2,
Line 45, "electron" should read -- electrons --.

Column 3,
Line 20, "micro-tip ," should read -- micro-tip, --; and
Line 28, "filed" should read -- field --.

Column 9,
Line 40, "and" should be deleted;
Line 43, "invention." should read -- invention; --;
Line 45, "method;" should read -- method; and --; and
Line 47, "method;" should read -- method. --.

Column 11,
Line 25, "same the" should read -- same as the --;
Line 27, "performed)" should read -- performed), --;
Line 42, "$V_{xOff}$" should read -- $V_{xOff}$, --;
Line 53, "momentary" should read -- momentarily --; and
Line 56, " $$\delta V = (V_{voff} - V_{yon}) \times (P \times Cd) / (Cpx + n \times Cd)$$ (Expression 1) "

should read

-- $$\delta V = (V_{yoff} - V_{yon}) \times (P \times Cd) / (Cpx + n \times Cd)$$ (Expression 1) --.

UNITED STATES PATENT AND TRADEMARK OFFICE

CERTIFICATE OF CORRECTION

PATENT NO. : 6,847,337 B2
DATED : January 25, 2005
INVENTOR(S) : Takeshi Ichikawa It is certified that error appears in the above-identified patent and that said Letters Patent is hereby corrected as shown below:

Column 12,
Line 1, "(=| $V_{yOn}$ - $V_{xOff}$ | - δV," should read -- (=| $V_{yOn}$ - $V_{xOff}$ | - δV) --.

Column 14,
Line 20, "film" should read -- film, --.

Column 15,
Line 57, "face place 96," should read -- face plate 96, --.

Column 20,
Line 16, "of" should be deleted; and
Line 41, "though," should read -- Although --.

Column 22,
Line 48, "of" should be deleted.

Signed and Sealed this

Eighteenth Day of October, 2005

JON W. DUDAS
*Director of the United States Patent and Trademark Office*